US005835821A

United States Patent [19]

Suzuki et al.

[11] Patent Number: 5,835,821

[45] Date of Patent: Nov. 10, 1998

[54] IMAGE FORMING APPARATUS

[75] Inventors: Hiroyuki Suzuki, Yokohama; Masahiro Itoh, Odawara; Masahiro Inoue, Yokohama; Kenichiro Waki, Kawasaki; Takeo Yamamoto, Toride; Ryo Inoue, Musashino, all of Japan

[73] Assignee: Canon Kabushiki Kaisha, Tokyo, Japan

[21] Appl. No.: 724,499

[22] Filed: Sep. 30, 1996

[30] Foreign Application Priority Data

| | | | |
|---|---|---|---|
| Sep. 28, 1995 | [JP] | Japan | 7-274900 |
| Sep. 28, 1995 | [JP] | Japan | 7-274903 |
| Jan. 29, 1996 | [JP] | Japan | 8-034313 |

[51] Int. Cl.[6] ..... G03G 15/02

[52] U.S. Cl. ..... 399/100; 399/50; 399/174

[58] Field of Search ..... 399/50, 100, 149, 399/150, 159, 168, 169, 174, 175, 176

[56] References Cited

U.S. PATENT DOCUMENTS

| | | | |
|---|---|---|---|
| 5,371,578 | 12/1994 | Asano et al. | 399/100 |
| 5,385,797 | 1/1995 | Nagahara et al. | 399/159 X |
| 5,568,232 | 10/1996 | Kashihara | 399/175 |
| 5,587,774 | 12/1996 | Nagahara et al. | 399/176 |
| 5,606,401 | 2/1997 | Yano | 399/175 |

*Primary Examiner*—Sandra L. Brase

*Attorney, Agent, or Firm*—Fitzpatrick, Cella, Harper & Scinto

[57] ABSTRACT

An image forming apparatus includes image bearing member for bearing a toner image; charging member contactable to the image bearing member to electrically charge the image bearing member; wherein $\delta V=|Vdc-Vs|$ is different between a first area of the image bearing member which is going to be image area and second area of the image bearing member which is going to be non-image area, where Vdc is a DC component of a voltage applied to the charging member, and Vs is is a potential of the image bearing member charged by the charging member.

20 Claims, 18 Drawing Sheets

DC ONLY

AC+DC

IMAGE FORMING APPARATUS

FIELD OF THE INVENTION AND RELATED ART

The present invention relates to an image forming apparatus, which comprises an image bearing member and a charging member placeable in contact with the image bearing member to charge the image bearing member.

In the past, a corona type charging device has been frequently employed as means for charging (inclusive of discharging) the image bearing member (object to be charged) such as an electrophotographic photosensitive member or an electrostatically recording dielectric member in an image forming apparatus of an electrophotographic or electrostatic recording system.

The corona type charging device is disposed close to the object to be charged, without contact between them, and the object to be charged is exposed to the corona discharge from the corona type charging device so that the surface of the object to be charged is charged to a predetermined polarity and a predetermined potential level.

In recent years, a contact type charging apparatus (directly charging apparatus) has been put to practical use to take advantage of the fact that a contact type charging apparatus produces less ozone, and consumes less electricity, than the corona type charging device.

In the case of the contact type charging apparatus, a charging member, to which voltage is applied, is placed in contact with the object to be charged, to charge the surface of the object to be charged to a predetermined polariy and a predetermined potential level.

A contact type charging apparatus employing a magnetic brush as the charging member is preferably. employed because of its reliability in terms of charging performance and contact between the two components. In a contact type charging apparatus employing a magnetic brush, electrically conductive magnetic particles are directly held in the form of a magnetic brush by a magnet, or magnetically held on the surface of a sleeve containing a magnet, by the magnet, and the magnetic brush is statically or rotatively placed in contact with the surface of an object to be charged. The object to be charged begins to become charged as voltage is applied to the magnetic brush.

A fur brush formed of electrically conductive fibers arranged in the form of a brush, or an electrically conductive rubber roller composed of electrically conductive rubber, is also preferably employed as a contact type charging member.

An injection charge system is one of such contact type charging systems. In the injection charge system, the surface of an object to be charged is provided with a charge injection layer, and in order to charge the surface of an object to be charged to predetermined polarity and potential level, charge is injected to the charge injection layer by placing a charging member, to which voltage is applied, in contact with the object to be charged. The injection charge system can give the object to be charged, a surface potential substantially equivalent to a DC voltage (DC bias) applied to the charging member, regardless of the presence of AC voltage (alternating bias) to be applied to the charging member. Since the injection charge system does not rely on the corona discharge phenomenon which is used when an object to be charged is charged with a corona type charging device, it can charge an object to be charged, absolutely without ozone production, and also can reduce electricity consumption.

However, since a contact type charging system places a charging member in contact with an object to be charged, the charging member is liable to be soiled as it picks up the contaminants on the object to be charged. The excessive contamination of the charging member reduces charging performance; for example, it induces nonuniform charge.

An image forming apparatus forms an image in the following manner. First, an electrostatic latent image of a target image is formed on the surface of an image bearing member, that is, the object to be charged, is charged by a contact type charging system, and then, the electrostatic latent image is visualized as a toner image. Therefore, toner adheres to the contact type charging member, or mixes with the charging member, and as images are repeatedly formed, toner accumulates on or in the contact type charging member.

Normally, a toner particle in the toner used in an image forming apparatus of the above-described type has a relatively high electrical resistance, and therefore, as a large amount of toner adhered to, or mixed with, the charging member, the resistance of the charging member increases. As a result, surface potential is nonuniformly induced. In particular, when a magnetic brush are employed as a charging member, a certain amount of the magnetic particles of the magnetic brush are pushed out of the magnetic brush as toner is mixed into the magnetic brush, and as time goes by, the amount of the magnetic particles in the magnetic brush gradually decreases. Consequently, the condition of the contact between the charging member and the object to be charged deteriorates, causing the surface of the object to be charged to be nonuniformly charged. Further, the magnetic particles having separated from the magnetic brush are liable to find a way into the developing means, which is liable to cause abnormal images such a streaky image.

In particular, in the case of a cleaner-less image forming apparatus, that is, an image forming apparatus comprising no specific cleaning apparatus which removes the residual toner from the surface of the object to be charged, after the toner image is transferred onto a transfer material, the post-transfer toner remaining on the object to be charged is directly transferred to the contact type charging member, and adheres to and/or mixes with the charging member. Therefore, the aforementioned problems are more conspicuous.

The post-transfer residual toner is preferably cleaned by a developing apparatus, but in this case, the occurrence of the abnormal image, which is caused as the magnetic particles separated from the magnetic brush mix into the developing apparatus, becomes conspicuous.

SUMMARY OF THE INVENTION

Accordingly, a primary object of the present invention is to provide an image forming apparatus capable of eliminating the occurrence of the charge nonuniformity caused by the toner adhesion to the charging member, or the mixing of the toner into the charging member, so that the occurrence of the abnormal image can be prevented.

Another object of the present invention is to solve problems that occur when the charging member is constituted of a magnetic brush, that is, to prevent the occurrence of the nonuniform charge resulting from the unreliable contact between the charging member and the object to be charged, which is caused by the magnetic particle reduction, so that creation of the abnormal image such as a streaky image caused when the magnetic particles separated from the magnetic brush mix into the developing apparatus can be prevented.

These and other objects, features and advantages of the present invention will become more apparent upon a consideration of the following description of the preferred embodiments of the present invention, taken in conjunction with the accompanying drawings.

DESCRIPTION OF THE PREFERRED EMBODIMENTS

<Embodiment 1> (FIGS. 1–8)

(1) General Structure of Image Forming Apparatus

Figure 1:
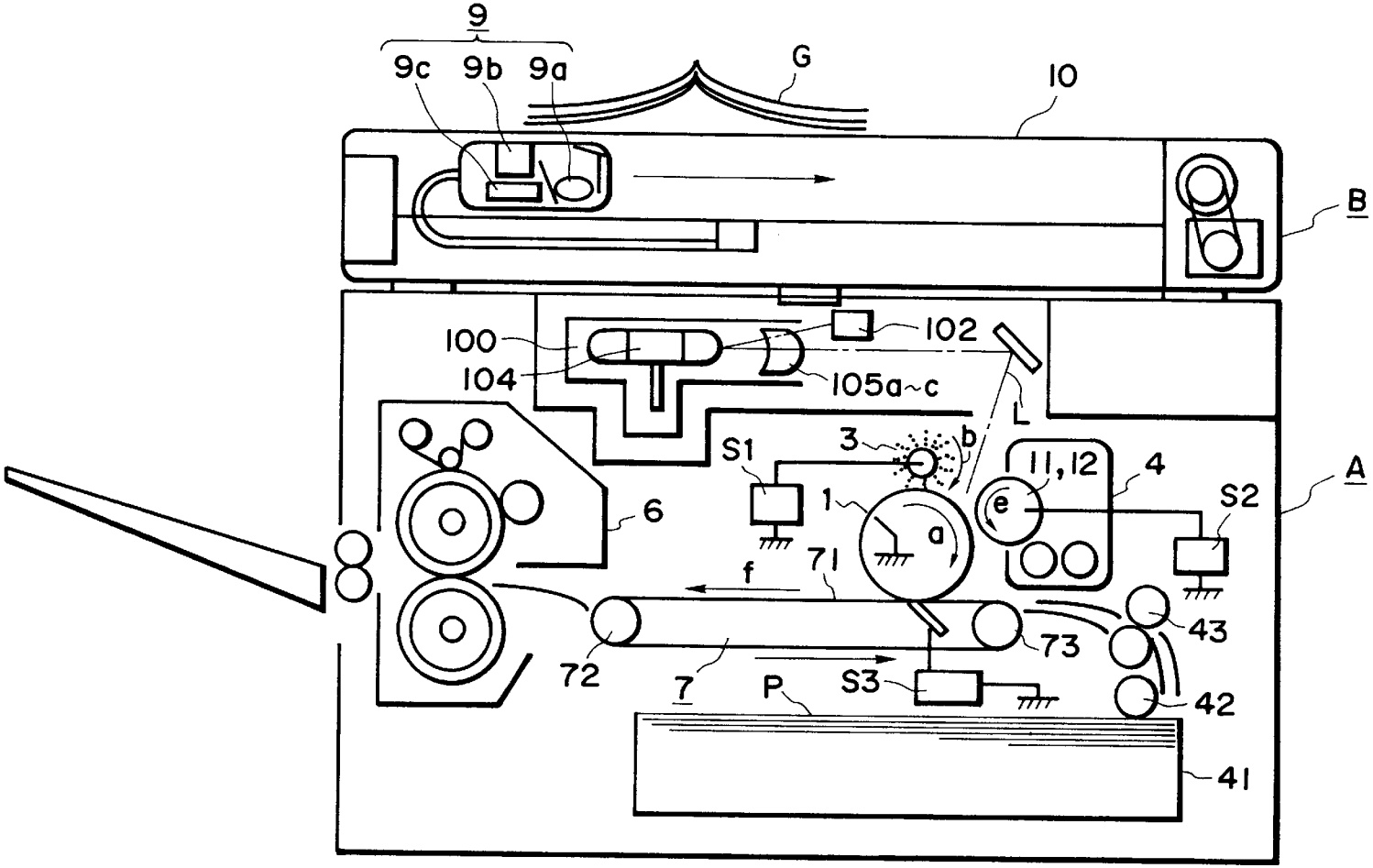
FIG. 1 is a schematic section of the image forming apparatus in the first embodiment of the present invention.

FIG. 1 is a schematic section of an image forming apparatus in accordance with the present invention. The image forming apparatus in this embodiment is a laser beam printer employing a transfer type electrophotographic process. It is also an apparatus employing a so-called cleanerless system as well as a contact type charging apparatus comprising a magnetic brush as a means for charging the image bearing member (object to be charged).

An alphabetic reference A designates a laser beam printer, and B designates an image scanner mounted on the printer.

(a) Image Scanner B

In the image scanner B, a reference numeral 10 designates a fixed plate glass on which an original G is to be placed. The original G is placed on the top side of this original placement glass plate 10, with the side to be copied facing downward, and an unillustrated plate for pressing the original is placed on the original.

A reference numeral 9 designates an image scanner unit comprising a lamp 9*a* for illuminating the original, a short focal distance lens array 9*b*, a CCD sensor 9*c*, and the like. As an unillustrated copy button is depressed, the unit 9 is driven from the home position located at the left-hand end of the glass, toward the right-hand end, following the bottom surface of the original placement glass plate 10, and after it reaches a predetermined ending point of the forward movement, it is driven backward to the starting point.

While the unit 9 is moved forward, the downward facing image surface of the original placed on the original placement glass plate 10 is sequentially illuminated in a scanning manner from the left-hand end to the right-hand end by the original image illuminating lamp 9*a* of the unit 9. The scanning light reflected from the surface of the original G is focused by the short focal distance lens array 9*b* to form an image on the CCD sensor 9*c*.

The CCD sensor 9*c* comprises a light receiving portion, a transfer portion, and an output portion. A light signal is converted to an electric charge signal by the light receiving portion, and is sequentially transferred to the output portion in synchronism with a clock pulse by the transfer portion. In the output portion, the electric charge signal is converted into a voltage signal, and then, the voltage signal is amplified and outputted after impedance reduction. The thus obtained analog signal is converted into a digital signal through a known image processing operation, and this digital signal is sent to a printer A.

In other words, the image data of the original G are read as sequential electric digital picture element signals (image signals) by the image scanner B.

(b) Printer A

In the printer A, a reference numeral 1 designates an electrophotographic photosensitive member, as the image bearing member, in the form of a rotary drum. The photosensitive drum 1 is rotatively driven about the central supporting axis at a predetermined peripheral velocity (process speed) in the clockwise direction indicated by an arrow mark a. While the photosensitive drum 1 is rotated, it is uniformly charged to a predetermined polarity (negative polarity in this embodiment) by a charging apparatus 3, which is a contact type charging apparatus employing a magnetic brush.

The uniformly charged surface of the photosensitive rotary drum 1 is exposed to a scanning laser beam L projected from a scanning laser portion (laser scanner), wherein this laser beam has been modulated with the image signals sent to the printer A from the image scanner B. As a result, an electrostatic latent image, which corresponds to the image data of the original G photoelectrically read by the image scanner, is sequentially formed from the leading end to the trailing end on the surface of the photosensitive rotary member 1.

The electrostatic latent image formed on the surface of the photosensitive rotary drum 1 is sequentially developed into a toner image by a developing apparatus 4 containing toner, from one end to the other. The development process employed in this embodiment is the reversal development process. Generally, toner is charged to the negative polarity.

Meanwhile, transfer materials P stored in a sheet feeder cassette 41 are sent out one by one by a sheet feeder roller 42, and are delivered to a transfer station 70 by a registration roller 43 with a predetermined control timing. The transfer station is constituted of the contact nip formed by the photosensitive drum 1 and the transfer belt 71 of a transfer belt apparatus as a transferring means. In the transfer station 70, the toner image is electrostatically transferred onto the surface of the transfer material P, on the side facing the photosensitive drum 1.

The transfer material P onto which the toner image has been transferred during its passage through the transfer station 70 is separated from the surface of the photosensitive drum 1 from one end to the other, and is sent to a fixing apparatus 6. In the fixing apparatus 6, the toner image is thermally fixed to the transfer material P. Thereafter, the transfer material with the fixed toner image is discharged as a copy or a print from the image forming apparatus.

After the toner image transfer onto the transfer material P, the photosensitive rotary drum 1 is repetitively used for the following image formation.

(c) Photosensitive Drum 1

As for the photosensitive drum 1, that is, the image bearing member, a conventional organic photosensitive member or the like may be employed. However, a photosensitive member comprising an organic photosensitive layer and a surface layer composed of a material having a low resistance value, an amorphous silicon type photosensitive member, or the like, which has a surface resistance of $10^9$–$10^{14}$ Ω.cm, may be preferably employed, since they can be charged using a charge injection method, and therefore, are effective to prevent ozone generation, and also to reduce power consumption. Further, they can improve charge characteristic.

The photosensitive member in this embodiment is a negatively chargeable organic photosensitive member. It comprises an aluminum drum base 1*a* having a diameter of 30 mm, and five layers: first to fifth layers laminated in this order from the bottom. These layers will be described later. The photosensitive drum 1 is rotated at a peripheral velocity of 100 mm/sec.

First layer is an approximately 20 μm thick electrically conductive undercoating layer, which is provided for smoothing the surface imperfection of the aluminum base 1*a*.

The second layer is a layer which prevents the injection of positive electric charge. More specifically, it plays a role in preventing the positive electric charge injected from the aluminum base 1 from canceling the negative electric charge given to the photosensitive member surface, and is an approximately 1 μm thick medium resistance layer composed of Amilian resin and methoxylmethyl nylon. Its resistance is adjusted to approximately $10^6$Ω.

The third layer is a charge generation layer, which is an approximately 0.3 μm thick layer composed of resin material and diazo group pigment dispersed in the resin material, and generates a positive-negative electric charge pair as it is exposed to light.

The fourth layer is a charge transfer layer, which is composed of polycarbonate resin and hydrazone dispersed in the resin, forming thereby a P-type semiconductor, and therefore, the negative charge given to the photosensitive surface is not allowed to move through this layer, and only the positive charge generated in the charge generation layer is allowed to be transferred to the photosensitive member surface.

The fifth layer is a charge injection layer, which is a coated layer composed of insulative resin and microscopic particles of $SnO_2$, as electrically conductive particles 12, dispersed in the resin. More specifically, $SnO_2$ particles doped with antimony to reduce resistance, which are light transmitting, electrically conductive filler and have a diameter of approximately 0.03 μm, are dispersed in the insulative acrylic resin at a ratio of 70 wt %. The mixture is coated to an approximate thickness of 3.0 μm, using a dipping method, a spraying method, a roll coating method, a beam coating method, or the like, to form the electric charge injection layer.

(d) Charging Apparatus 3

Figure 2:
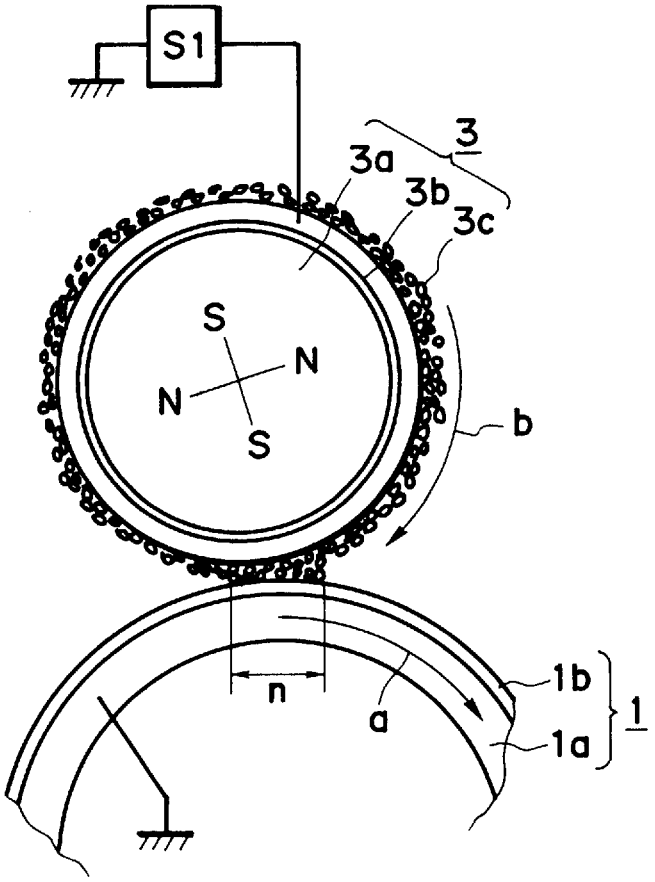
FIG. 2 is a schematic section of the magnetic brush portion of the image forming apparatus illustrated in FIG. 1.

FIG. 2 is an enlarged schematic view of the essential portion of the charging apparatus 3. The charging apparatus 3 in this embodiment is a contact type charging apparatus employing a magnetic brush (hereinafter, magnetic brush). It is a charging apparatus of a rotational sleeve type, and comprises fixed magnetic roller 3*a* having a diameter of 16 mm, a nonmagnetic SUS sleeve 3*b*, and a magnetic brush layer 3*c*. The SUS sleeve 3*b* is rotatively fitted around the magnetic roller 3*a*. The magnetic brush layer 3*c* is composed of magnetic particles held on the peripheral surface of the sleeve 3*b* by the magnetic force of the magnetic roller 3*a*.

The magnetic particle for forming the magnetic brush layer 3*c* preferably has an average particle diameter of 10–100 μm, a saturation magnetization of 20–250 emu/cm$^3$, and a resistance of $1\times10^2$–$1\times10^{10}$ Ω.cm. In consideration of possible presence of insulation related imperfection, such as a pinhole, of the photosensitive drum 1, it is preferable to employ magnetic particles having a resistance of no less than $1\times10^6$ Ω.cm.

As for the resistance value of the magnetic particle, two grams of magnetic particles are placed in a metallic cell having a bottom size of 228 mm$^2$, and are packed applying a weight of 6.6 kg/cm$^2$. Then, the resistance is measured while applying a voltage of 100 V.

In order to improve charging performance, it is preferable to employ magnetic particles having a resistance value which is as small as possible. Therefore, in this embodiment, 40 g of magnetic particles having an average particle diameter of 25 μm, a saturation magnetization of 200 emu/cm$^3$, and a resistance of $5\times10^6$ are held on the peripheral surface of the sleeve 3*b* by the magnetic force to form the magnetic brush layer 3*c*.

As for the composition of the magnetic particle, magnetic material is dispersed in resin material, and also, carbon black is dispersed to render the particles electrically conductive and to adjust the resistance of the particles; the surface of the pure magnetite such as ferrite is oxidized or reduced to adjust the resistance; or the Surface of the pure magnetite such as ferrite is coated with resin material to adjust the resistance.

The magnetic brush layer 3*c* of the magnetic brush 3 is placed in contact with the surface of the photosensitive drum 1, forming a contact nip n (charging nip). The width of the contact nip is 6 mm.

The sleeve 3*b* is rotatively driven, with a predetermined charge bias being applied hereto from a charge bias application power source S1, in the clockwise direction b indicated by an arrow mark at a peripheral velocity of 150 mm/sec, wherein the rotational direction of the sleeve 3*b* in the contact nip n is opposite to the rotational direction of the photosensitive drum 1 being rotated at a peripheral velocity of 100 mm/sec. As a result, the surface of the photosensitive rotary drum 1 is rubbed by the magnetic brush layer to which the charge bias is applied, whereby the surface of the photosensitive layer 1*b* of the photosensitive drum 1 is uniformly charged to a desired potential level (primary charge); the photosensitive drum 1 is charged using the charge injection system. Charge uniformity tends to improve in proportion to peripheral velocity.

Figure 3:
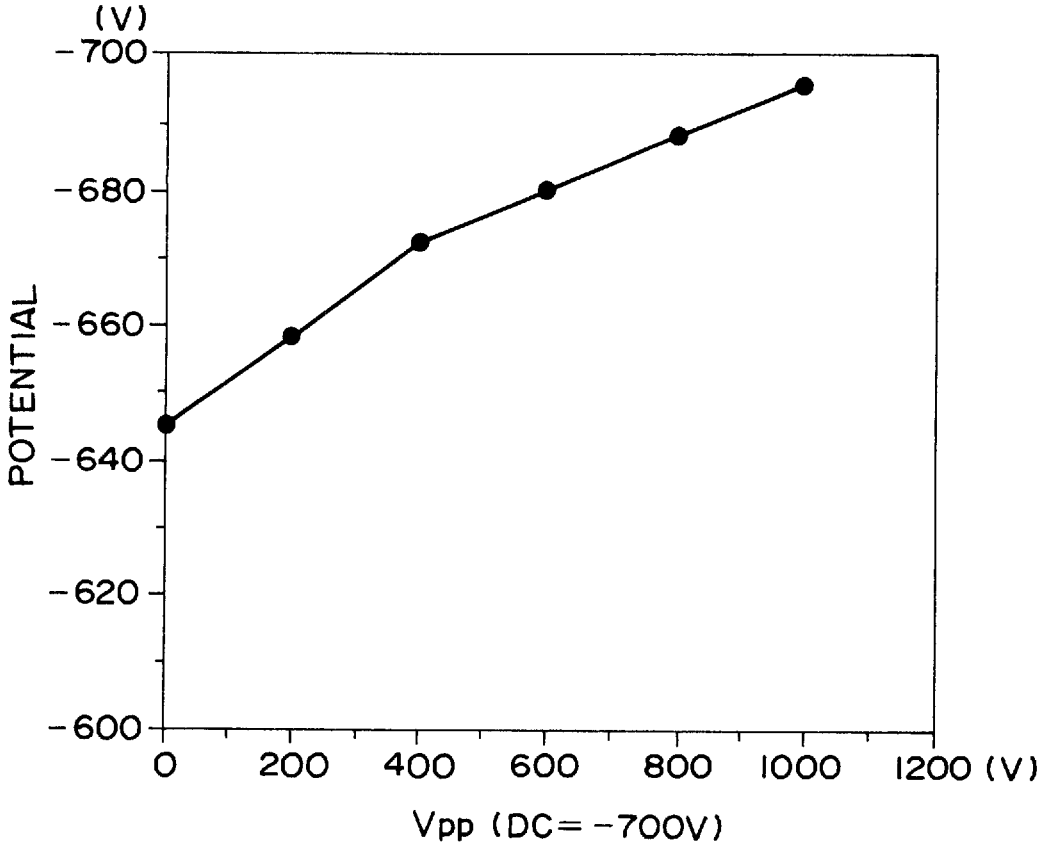
FIG. 3 is a graph depicting the relationship between the alternating voltage applied to the magnetic brush and the resulting potential level.

FIG. 3 shows the relationship between the amplitude of the applied bias and the potential level after the first rotation is completed while an oscillating voltage having a rectangular waveform and a frequency of 1,000 Hz is applied to the magnetic brush as the contact type charging member. The difference between the DC component of the applied bias and the potential level after the first rotation becomes smaller as the amplitude of the oscillating voltage is increased.

More specifically, when the DC component of the bias applied to the magnetic brush 3 is $V_{dc}$, and the surface potential level of the charged photosensitive drum 1 is $V_s$, charge uniformity improves as the potential contrast $\delta V=|V_{dc}-V_s|$ drops below approximately 40 V.

Therefore, in this embodiment, in order to improve the charge characteristic, an oscillating voltage composed of a DC voltage of −700 V and an AC voltage superposed thereon is applied to the magnetic brush 3, wherein the AC voltage has a rectangular waveform, a frequency of 1,000 Hz, and a peak-to-peak voltage of 800 V.

(e) Laser Scanner 100

Figure 4:
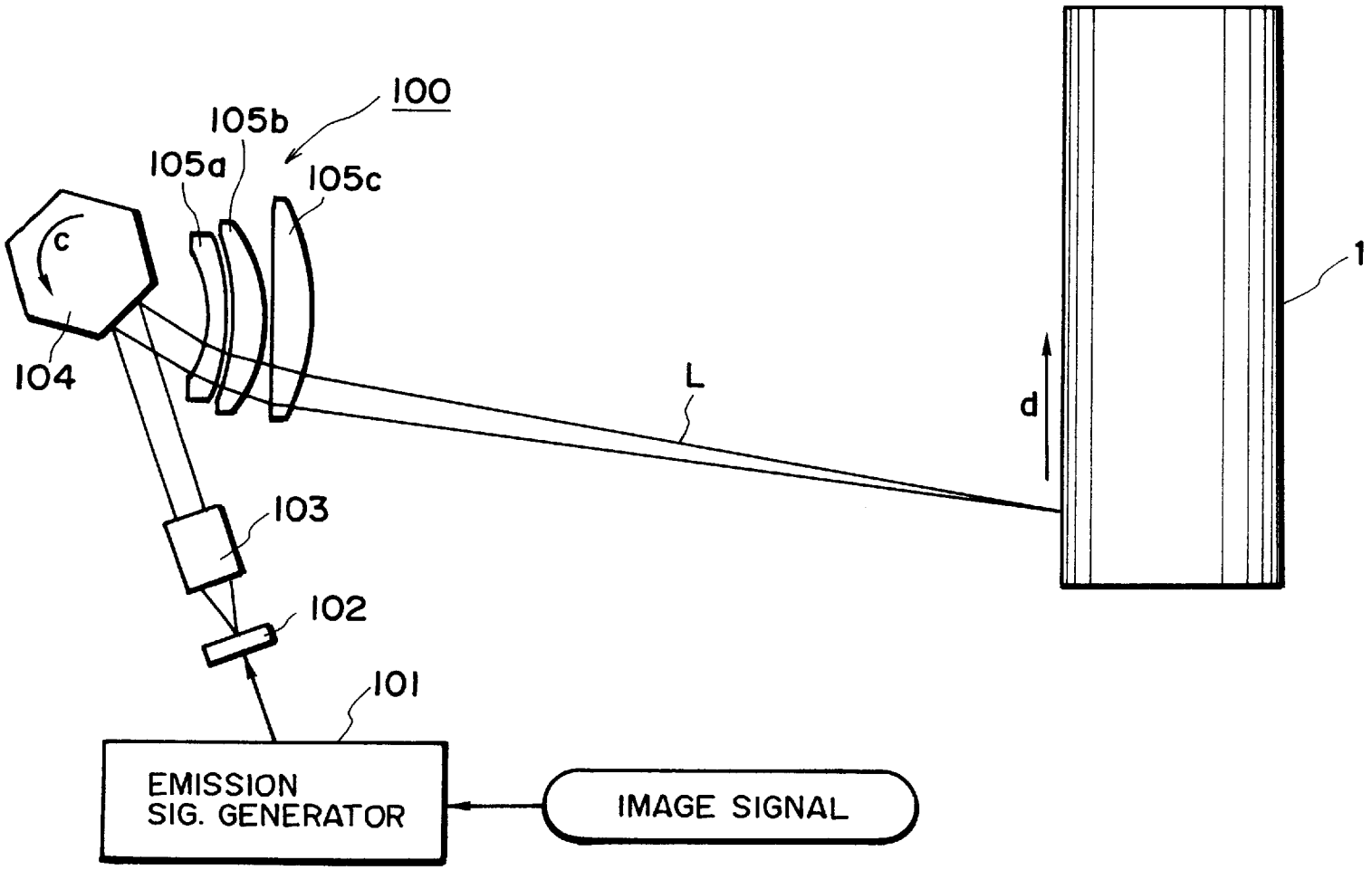
FIG. 4 is a schematic section of a laser scanner.

FIG. 4 illustrates the general structure of a laser scanner 100 as an image exposing means employing a scanning laser beam exposure system.

The surface (surface of photosensitive rotary drum) to be scanned is exposed to a scanning laser beam L in the following manner. First, a solid laser element 102 is turned on and off by a light signal generator 101, with a predetermined timing in correspondence with the inputted image signals. The laser beam emitted from the solid laser element 102 is converted into a substantially parallel pencil of rays by a collimator lens system 103. The parallel pencil of rays are deflected by a rotary polygon mirror 104 rotating at a high speed in the direction of an arrow mark c. The deflected parallel pencil of rays is projected through an f-θ lens group comprising lenses 105*a*, 105*b* and 105*c*, being thereby focused as a spot of light on the surface 1 to be scanned. As the rotary polygon mirror 104 rotates, the spot is moved in a manner to scan the surface 1 to be scanned, in the direction of an arrow mark d. As the surface 1 to be scanned is scanned a single scanning line by the laser beam L as described above, an exposure light intensity distribution is formed for the single scanning line. Each time the surface 1 to be scanned is scanned by a single scanning line, it is scrolled by a predetermined amount in the direction perpendicular to the scanning direction of the laser beam L. As a result, an exposure light intensity distribution corresponding to the entire image signals is formed on the surface 1 to be scanned.

In other words, as the uniformly charged surface of the photosensitive drum 1 is exposed to the scanning pencil of rays which are emitted from the solid laser element 102 turned on and off in response to the image signals, and is moved in a scanning manner, by the rotary polygon mirror 104 rotating at a high speed, an electrostatic latent image corresponding to the scanning exposure pattern (exposure light intensity distribution) is formed on the surface of the photosensitive drum 1.

(f) Developing Apparatus 4

Generally speaking, there are four methods for developing an electrostatic latent image: single component noncontact development method, single component contact development method, two component contact development method, and two component noncontact development method. In most of the methods, toner is coated on a sleeve to be carried to a development station. In the single component noncontact development method, nonmagnetic toner is coated on a sleeve using a blade or the like, or magnetic toner is coated using magnetic force. In this case, development occurs with no contact between the photosensitive drum and the toner layer on the sleeve. In the single component contact development method, development occurs as the toner layer formed on the sleeve in the above described manner makes contact with the photosensitive drum. In two component contact development method, a mixture of toner particles and magnetic carrier is used as a developer, and this developer is conveyed to the development station by the magnetic force to develop the latent image in a noncontact manner. In the two component noncontact development method, a latent image is developed with no contact between the aforementioned two component developer layer and the photosensitive drum. In consideration of higher picture quality and stability, the two component contact development method is more widely used.

Figure 5:
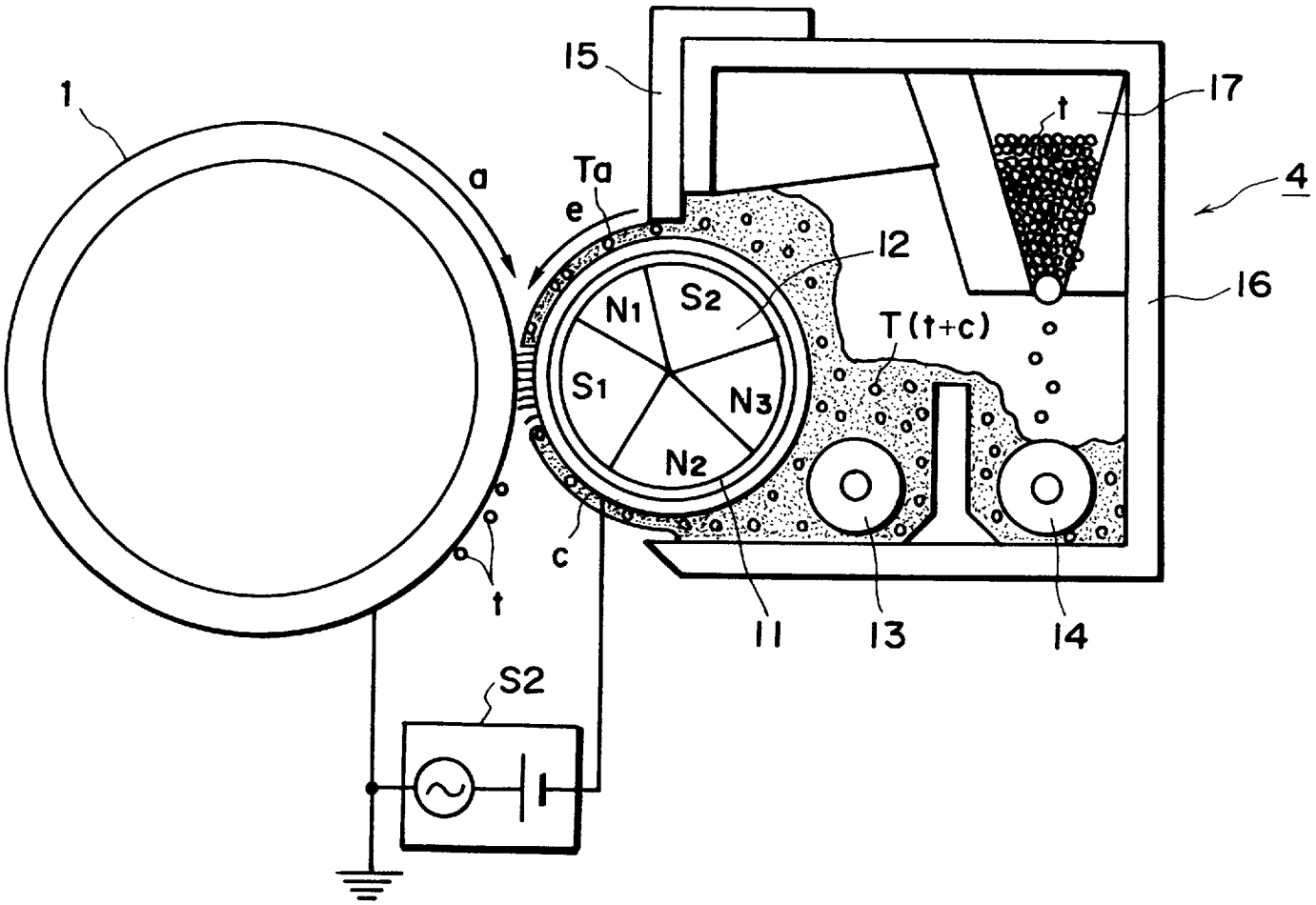
FIG. 5 is a schematic section of a developing apparatus which uses two component developer.

The developing apparatus 4 in this embodiment is a developing apparatus based on the two component contact development method (developing apparatus using the two component developer and a magnetic brush), which is advantageous in terms of image quality, image stability, and efficiency with which the residual toner is mechanically recovered from the photosensitive drum 1 by a magnetic brush. FIG. 5 is a schematic section of the developing apparatus 4. In the drawing, a reference numeral 11 designates a development sleeve which is rotatively driven in the counterclockwise direction e indicated by an arrow mark; 12, a magnetic roller fixedly disposed in the development sleeve 11; 13 and 14, stirring screws; 15, a regulator blade disposed to form a thin layer of developer T on the surface of the development sleeve 11; 16, a developer container; and 17 designates a hopper for refilling toner.

The development sleeve 11 is disposed in such a manner that its minimum distance to the photosensitive drum 1 becomes approximately 500 μm at least during development, so that the thin developer layer Ta formed on the surface of the development sleeve 11 is allowed to come in contact with the photosensitive drum 1 in the development station to develop a latent image.

The developer in this embodiment is the two component developer comprising nonmagnetic, insulative, and negatively chargeable toner particles having an average particle diameter of 6 μm, and titanium oxide particles having an average particle diameter of 20 nm. The toner particles t are produced using a pulverizing method. The ratio of the titanium oxide particles to the toner particles is 1 wt %. The carrier c in this embodiment is a magnetic carrier having a saturation magnetization of 205 emu/cm$^3$, and an average particle diameter of 35 μm. The toner particles t and the carrier c are mixed at a ratio of 6:94 to be used as a developer T.

Here, a development process in which the aforementioned electrostatic latent image is visualized using the developing apparatus 4 and the two component magnetic brush system will be described along with a system for circulating the developer. First, as the development sleeve 11 is rotated, developer is picked up by the magnetic pole N3, and is conveyed toward the development station. While the developer carried on the development sleeve 11 is conveyed past a pole S1 and a pole N1, it is regulated by the regulator blade 15 disposed perpendicular to the development sleeve 11, whereby a thin layer Ta of developer is formed on the development sleeve 11. As a given surface area of the development sleeve 11 is rotated to the development pole S1, the developer in the thin developer layer on this area is caused to cluster in the form of a broom tip by the magnetic force. The aforementioned electrostatic latent image is developed by this developer cluster in the form of a broom tip, and at the same time, the post-transfer residual toner which has been negatively charged by a charging device is returned to the surface of the development sleeve 11. Thereafter, the developer on the development sleeve 11 is returned to the developer container 16 by the repulsive magnetic fields of poles N3 and N2.

To the development sleeve 11, a DC voltage and an AC voltage are applied from a power source S2. In this embodiment, the DC voltage is −500 V, and the AC voltage has a peak-to-peak voltage $V_{pp}$ of 1,500 V and a frequency Vf of 2,000 Hz. In the developing station, the toner particles in the toner cluster in the form of a broom tip adhere to the electrostatic latent image, on the portions having the bright portion potential level, whereby the electrostatic latent image is developed.

Generally, in the two component development method, application of alternating voltage increases risk in that it is liable to cause fog, although it increases development efficiency, and also improves picture quality. Therefore, normally, occurrence of fog is prevented by providing potential difference between the DC voltage applied to the developing apparatus 4 and the surface potential level of the photosensitive drum 1.

The toner density (mixing ratio between toner and carrier) in the developer in the developer container 16 gradually drops as the toner is consumed to develop the electrostatic latent image. The toner density in the developer in the developer container 16 is detected by an unillustrated detecting means. It is preferable that control is executed so that as the toner density drops to a predetermined tolerable minimum density, a fresh supply of toner is supplied from a toner supply portion 17 to be added to the developer in the developer container 16 in order to always keep the toner density in the developer in the developer container 16 in a predetermined tolerance range.

The volumetric average particle diameter of toner is preferably measured using the following method. As a measuring apparatus, Coulter counter TA-11 (product of Coulter Co.) is employed, which is connected to an interface (product of Nikkaki) for outputting numeric average distribution and volumetric average distribution, and a CX-i personal computer (product of Canon). The electrolyte is 1% water solution of first class sodium chloride.

As for the measuring method, 0.1–5.0 ml of surfactant (preferably, alkyl benzene sodium sulfate) as dispersant is added to 100–150 ml of the aforementioned electrolyte, and to this mixture, a sample of the material to be tested is added by 0.5–50 mg.

The electrolyte in which the sample is suspended is placed in an ultrasonic dispersion device for approximately 1–3 minutes to evenly disperse the test sample, and the volumetric distribution is obtained by measuring the particle size distribution for the particles having a diameter range of 2–40 μm, using the aforementioned Coulter counter TA-11 fitted with a 100 μm aperture. The volumetric average particle diameter of the test sample is calculated from the volumetric distribution.

(g) Transferring Apparatus 7

The transferring apparatus in this embodiment is a belt type transferring apparatus, in which an endless transfer belt 71 is stretched between a driver roller 72 and a follower roller 73, and is rotatively driven in the counterclockwise direction f indicated by an arrow mark at a substantially the same peripheral velocity as that of the photosensitive drum 1. In the space surrounded by the endless transfer belt 71, a transfer charge blade 74 is disposed, and the substantially center portion of the top loop portion of the belt 71 is pushed against the surface of the photosensitive drum 1 by the transfer charge blade 74, forming a transfer nip 70.

The transfer material P is placed on the top surface of the top loop portion of the belt 71, and is delivered to the transfer nip 70. At the moment when the leading end of the transfer material P enters the transfer nip 70, a predetermined transfer bias is applied to the transfer charge blade 74 from a bias application power source S3, whereby transfer charge having a polarity opposite to the toner polarity is given from the back side of the transfer material P. As a result, the toner image on the photosensitive drum 1 is transferred onto the top surface of the transfer material P from the leading end to the trailing end.

In this embodiment, a 75 μm thick polyimide resin belt is employed as the belt 71. The material for the belt 71 is no necessarily limited to polyimide resin. For example, plastic material such as polycarbonate resin, polyethylene terephthalate resin, polyvinylidene fluoride resin, polyethylene naphthalate resin, polyether etherketon resin, polyether sulfone resin, and polyurethane resin, flourorubber, or silicone rubber can be preferably used. Also, the thickness of the belt 71 is not limited to 75 μm; the thickness is preferably in an approximate range of 25–2,000 μm, more preferably, 50–150 μm.

The transfer charge blade 74 has a resistance of $1\times10^5$–$1\times10^7\Omega$, a thickness of 2 mm, and a length of 306 mm. To this transfer charge blade 74, a bias of +15 mA is applied to transfer the toner image, using a constant current control.

As described above, the toner image formed on the photosensitive drum 1 is electrostatically transferred onto the transfer material P by the transfer charge blade 74.

The transfer belt 71 is made to double as a means for conveying the transfer material P from the transfer nip 70 to a fixing a apparatus 6. The transfer material P having passed through the transfer nip 70 is separated from the surface of the photosensitive drum 1, is conveyed to the fixing apparatus 6 by the transfer belt 71, and is introduced into the fixing apparatus 6.

(2) Cleaning of Contact Type Charging Member 3

After the toner image is transferred onto the transfer material P, a certain amount of toner (post-transfer residual toner) remains on the surface of the photosensitive drum 1.

In the case of an image forming apparatus in which a cleaning apparatus is disposed on the downstream side of the transfer station, the post-transfer residual toner is removed by the cleaning apparatus. However, if the charging means 3 for the photosensitive drum 1 in such an image forming apparatus is a contact type charging member, a certain amount of the residual toner which escapes the cleaning apparatus adheres to, or mixes into, the contact type charging member, contaminating the contact type charging member.

When an image forming apparatus is a so-called cleanerless apparatus like the apparatus in this embodiment, all of the residual toner on the photosensitive drum 1 reaches the contact type charging member, adhering to, and mixing into, the charging member; therefore, the contamination by toner is more conspicuous.

As stated before, when a large amount of toner adheres to, and mixes into the contact type charging member 3, the resistance of the charging member 3 increases, which causes nonuniformity of charge. Further, when a magnetic brush is employed as the charging member, magnetic particles are pushed out of the brush by the excessive mixing of toner into the brush, and with the elapse of time, the amount of the magnetic particles in the brush gradually decreases, which causes charge nonuniformity due to instable contact, and also, the magnetic particles separated from the magnetic brush are liable to invade the developing means, which causes problems such as the creation of abnormal images, for example, a streaky image.

Also, the post-transfer residual toner is often reversed in charge polarity due to the separation discharge or the like which occurs during the transfer process. The toner having been reversed in polarity is difficult to recover into the developing apparatus at the same time as the latent image is developed.

Therefore, in this embodiment, first, the post-transfer residual toner carried to a charging region n is efficiently taken in by the contact type charging member 3, and then, the toner taken in by the charging member 3 is reversed in polarity by the charging member 3 so that it can be efficiently expelled from the charging member 3 and transferred onto the object 1 to be charged, to purify the contact type charging member 3. The expelled toner is efficiently recovered by the developing apparatus 4 at the same time as the latent image is developed by the developing apparatus 4. Thus, the contact type charging member 3 is prevented from excessively contaminated. In the developing apparatus 4, the bias voltage applied to the development sleeve is set to a level between the dark portion potential and the bright portion potential of the drum 1, in order to generate an electric field by which the residual toner on the drum 1, on the areas having the dark portion potential, is transferred onto the development sleeve 11 from the drum 1, at the same time as the toner on the sleeve 11 is adhered to the drum 1, on the areas having the bright portion potential, to develop the latent image.

More specifically, in this embodiment, the post-transfer residual toner having reached the charge region n as the photosensitive drum 1 was rotated is taken in by the magnetic brush 3 as the contact type charging member. In the magnetic brush 3 which takes in the residual toner, the reversely charged toner (positively charged toner) is reversed in polarity (charged to the negative polarity in this embodiment) by the friction between the toner and the magnetic brush. During this process, application of only DC voltage to the magnetic brush 3 cannot cause the magnetic brush 3 to satisfactorily take in the toner, but when AC voltage is applied to the magnetic brush 3, an oscillating electric field is generated between the photosensitive drum 1 and the magnetic brush 3, and therefore, the toner can be easily taken in by the magnetic brush 3.

With the provision of the above arrangement, the reversely charged toner (positively charged toner) is reversed in polarity, becoming negatively charged, by the friction between the toner and the magnetic brush 3, and therefore, can be recovered in the developing apparatus 4 at the same time the latent image is developed by the developing apparatus 4. However, there occurs a problem in that application of AC voltage to the magnetic brush 3 increases charging capacity to an extreme level. When the DC component of a bias applied to the magnetic brush 3 is a voltage $V_{dc}$, and a surface potential to which the surface of the photosensitive drum 1 is charged is a voltage of $V_s$ the potential contrast $\delta V$ is the difference between the two voltages, that is, $|V_{dc}-V_s|$. In this embodiment, $V_{dc}$ is −700, and therefore, when an AC voltage having a frequency of 1,000 Hz and a $V_{pp}$ of 800 V is applied to the magnetic brush 3, $V_s$ is −690 V; therefore, $\delta V$ is 10 V.

The studies and experiments conducted by the inventors of the present invention revealed that unless the potential contrast $\delta V$ exceeds 50 V, the post-transfer residual toner taken into the magnetic brush 3 cannot be easily expelled therefrom and transferred onto the photosensitive drum 1. While the residual toner is expelled from the magnetic brush by the electrical force, the same electrical force also acts on the magnetic particles in the magnetic brush 3 in a manner to adhere them to the photosensitive drum 1, but they are not moved to be adhered to the photosensitive drum 1, because of the presence of the magnetic force.

Figure 6:
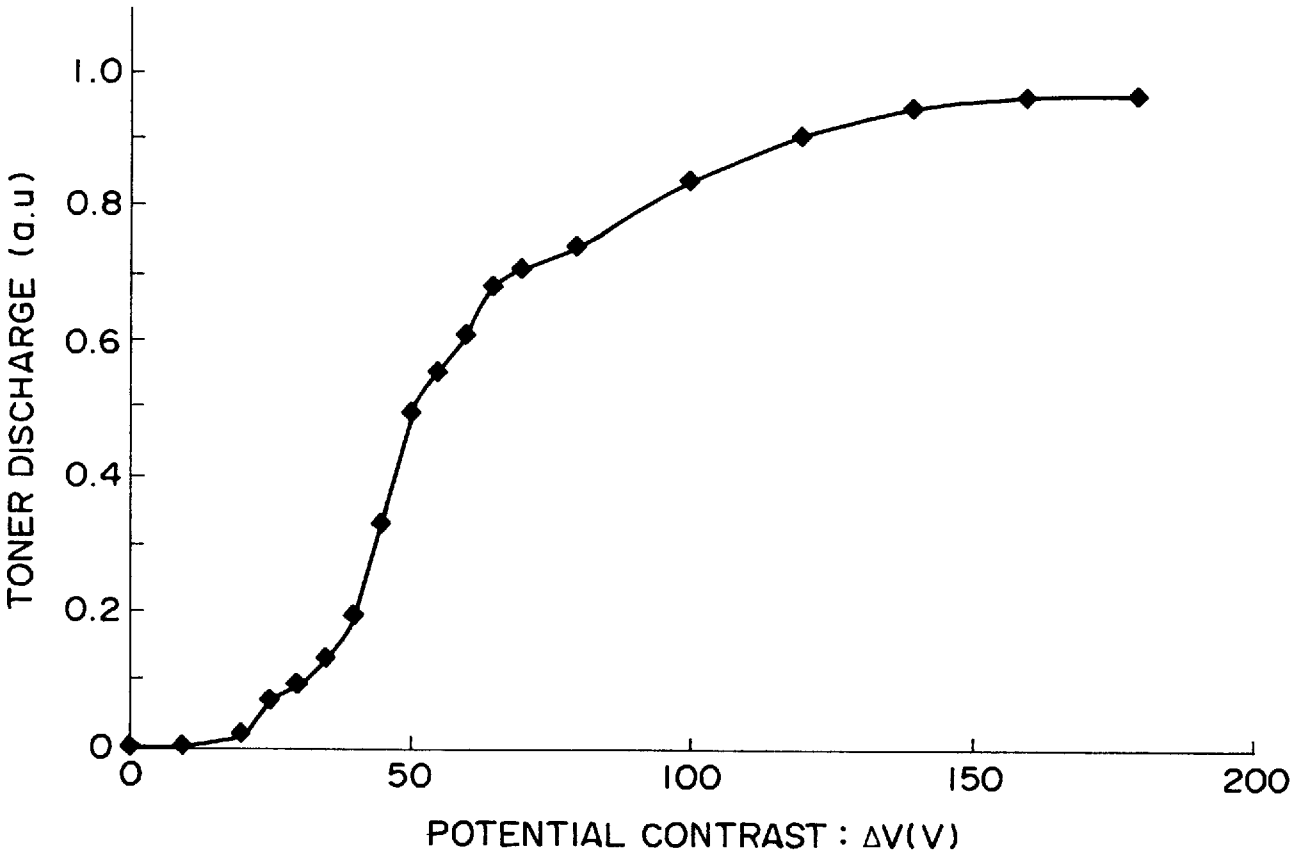
FIG. 6 is a graph showing the relationship between the potential level contrast and the amount of the expelled toner.

FIG. 6 shows the relationship between the potential contrast $\delta V$ and the amount of the expelled toner. As described above, when alternating voltage is applied to the magnetic brush 3, and therefore, the potential contrast $\delta V$ is 10 V, being extremely high, the post-transfer residual toner having mixed into the magnetic brush 3 cannot be easily expelled from the brush and transferred onto the photosensitive drum 1. As a result, the magnetic brush 3 is gradually contaminated with the toner, and when the toner is mixed into the magnetic brush 3 by an amount exceeding a predetermined amount, charging capacity is reduced even when alternating voltage is superposed, which admittedly depends on other factors such as the resistance value of the toner. The decline of charge capacity that occurs when toner having higher resistance than the magnetic material, that is, the structural member of the magnetic brush 3, mixes into the magnetic brush 3 is such decline of charge uniformity that occurs when it becomes impossible for the magnetic brush 3 and the surface of the photosensitive drum 1 to make smooth contact. This phenomenon similarly occurs also when only DC voltage having lower charge capacity is applied.

Therefore, in this embodiment, while no image is formed, that is, when a certain region of the image bearing member surface, which is to become the region on which no image is formed, is at the charging position, alternating voltage is not superposed on the bias to be applied to the magnetic brush 3. In other words, a period in which only DC voltage is applied is provided (as described above, application of only DC voltage results in inferior charge uniformity, which does not create any specific problem as long as no image is being formed).

The above arrangement can be more easily understood by referring to FIG. 3. When DC voltage alone is applied. the surface potential $V_s$ of the photosensitive drum 1 is approximately −645 V, and $\delta V=|V_{dc}-V_s|$is approximately 55 V; therefore, the residual toner can be satisfactorily expelled.

Figure 7:
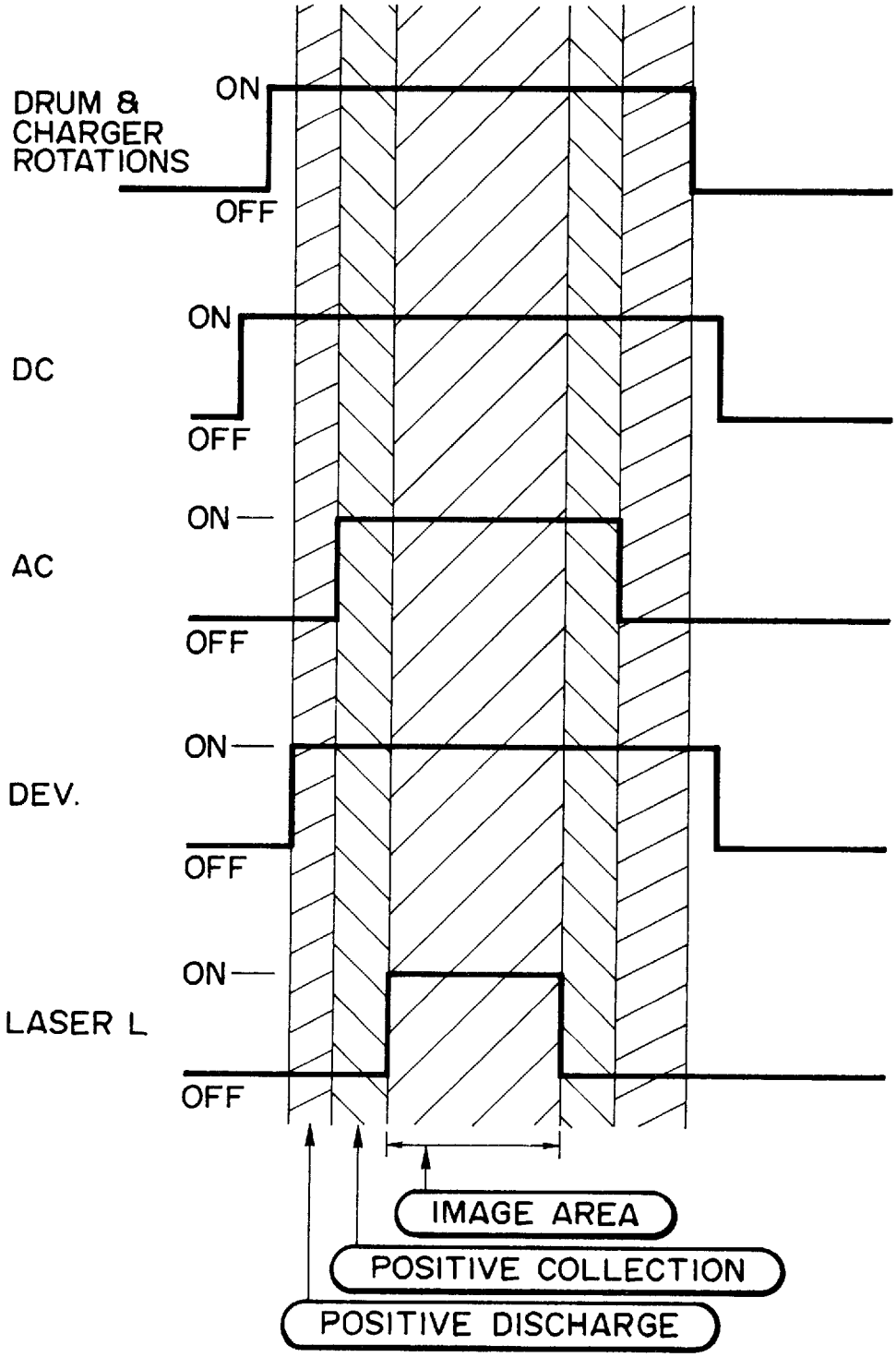
FIG. 7 is a control timing chart.

Further, when voltage is applied with such a timing as the one given in FIG. 7, and a period in which only DC voltage is applied is provided immediately before the beginning of image formation, the toner in or on the magnetic brush 3 is uniformly expelled onto the photosensitive drum 1, and is recovered by the developing apparatus 4 as much as possible. Immediately thereafter, the toner on the photosensitive drum 1 is aggressively recovered into the developing apparatus 4 by applying alternating voltage that is, by uniformly charging the surface of the photosensitive drum 1. Then, an actual image forming process is carried out while applying alternating voltage. In this manner, an image is always formed without the contamination of the charging member; it becomes possible to continuously produce preferable images.

The provision of the above structure makes it possible to expel the toner out of the charging member even when the toner mixes into the magnetic brush 3 as the contact type charging member, and therefore, the contamination of the magnetic brush by the toner can be prevented, and also, the magnetic particles forming the magnetic brush are prevented from separating from the magnetic brush. In other words, the magnetic brush is prevented from gradually losing the magnetic particles. Therefore, it becomes possible to solve such a problem that even when alternating voltage is applied, charge capacity does not sufficiently increase to prevent production of a defective image caused by insufficient charge capacity.

In this embodiment, the toner in or on the magnetic brush 3 is uniformly expelled onto the photosensitive drum 1 by providing a period in which only DC voltage is applied while no image is formed. However, application of alternating voltage does not need to be completely stopped. For example, it was confirmed that charge capacity could be reduced, as shown in FIG. 3, to effectively expel the toner, just by reducing the amplitude of the alternating voltage to approximately 200 V or below.

Further, a simple statement in this embodiment that the timing with which DC voltage alone is applied while no image is formed means the following. That is, the time when DC voltage alone is to be applied may be any time as long as no image is being formed; for example, during the period for preliminary rotation, that is, the period before a certain surface region of the photosensitive drum 1, which is to serve as a region on which an image is formed, reaches the charging position, or during the period for post-image formation rotation, that is, the period after the aforementioned image formation region passes the charging position. Further, this process of applying DC voltage alone may obviously be carried out after each image formation, during sheet intervals when copies are continuously made, or with predetermined intervals.

Figure 8:
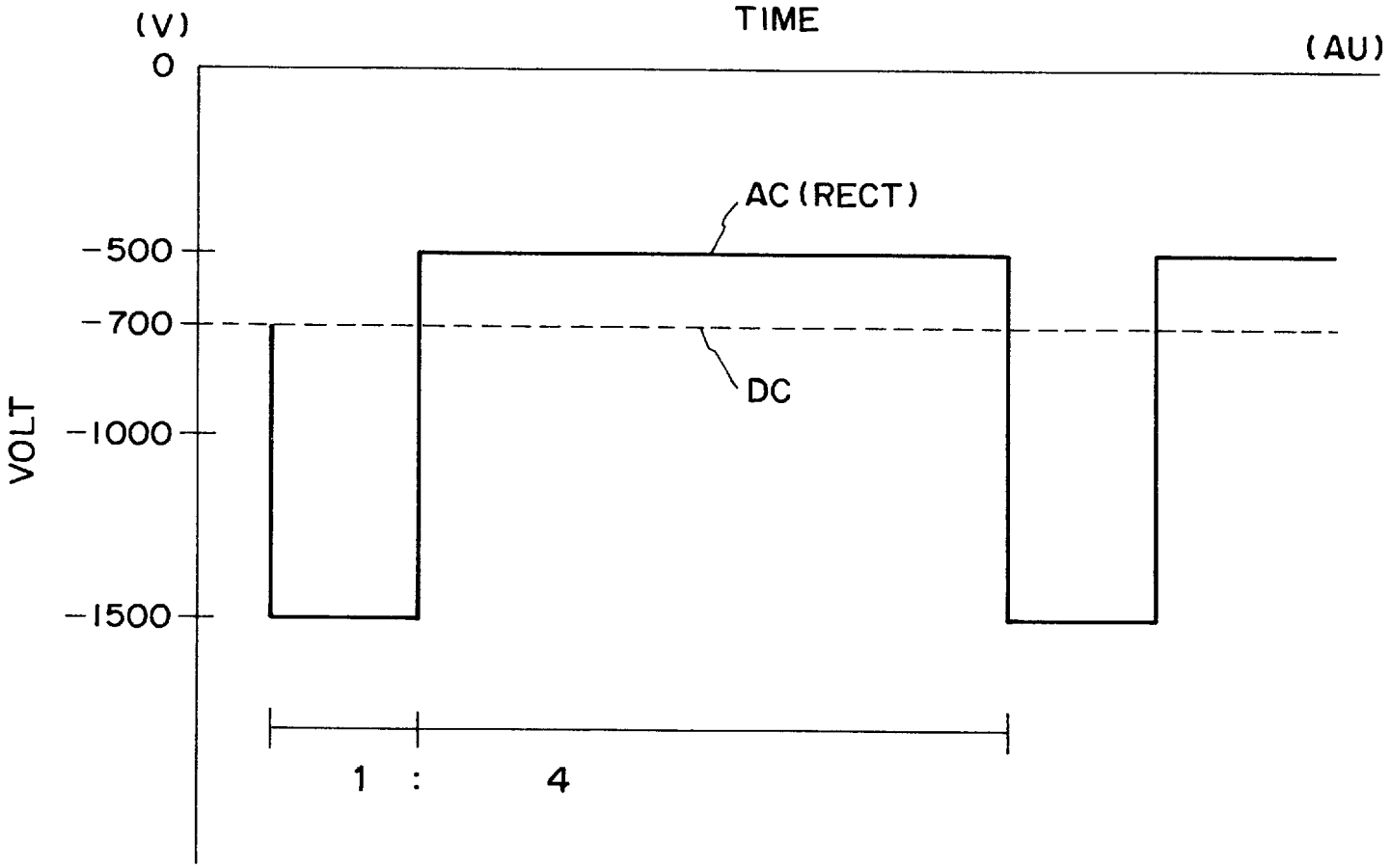
FIG. 8 is a graph depicting the waveform of the alternating voltage having a duty ratio of 1:4.

Further, in this embodiment, while no image is formed (while the photosensitive drum 1 is not charged for image formation, by the charging member), application of alternating voltage is stopped, or the amplitude of alternating voltage is rendered smaller than while an image is formed. However, the present invention is not limited by this arrangement. Any arrangement is acceptable as long as the capacity for charging the photosensitive drum 1 can be kept low by the arrangement while no image is formed. For example, an arrangement may be made so that an alternating voltage having a rectangular waveform is applied while an image is formed, but an alternating voltage in the form of a sine wave is applied while no image is formed. Also, an alternating voltage having a rectangular waveform in which the top and bottom peak voltages are different in duty ratio, as shown in FIG. 8, may be applied. Further, the capacity for charging the photosensitive drum may be reduced by making such an arrangement that the waveform remains rectangular, but the frequency is increased into the high-frequency range. It is obvious that the same effects as described above can be obtained by these arrangements.

Further, this embodiment is described with reference to a system in which a nonmagnetic sleeve fitted around a magnetic roller is rotated. However, application of the present invention is not limited to this structure. For example, even in the case of a system which has substantially the same structure as the above except that the magnet rotates, or a system which comprises only a magnet roller and in which the magnet roller itself rotates, the same effects as those described above can be obtained, as long as the surface of the roller is given electrical conductivity.

Figure 9:
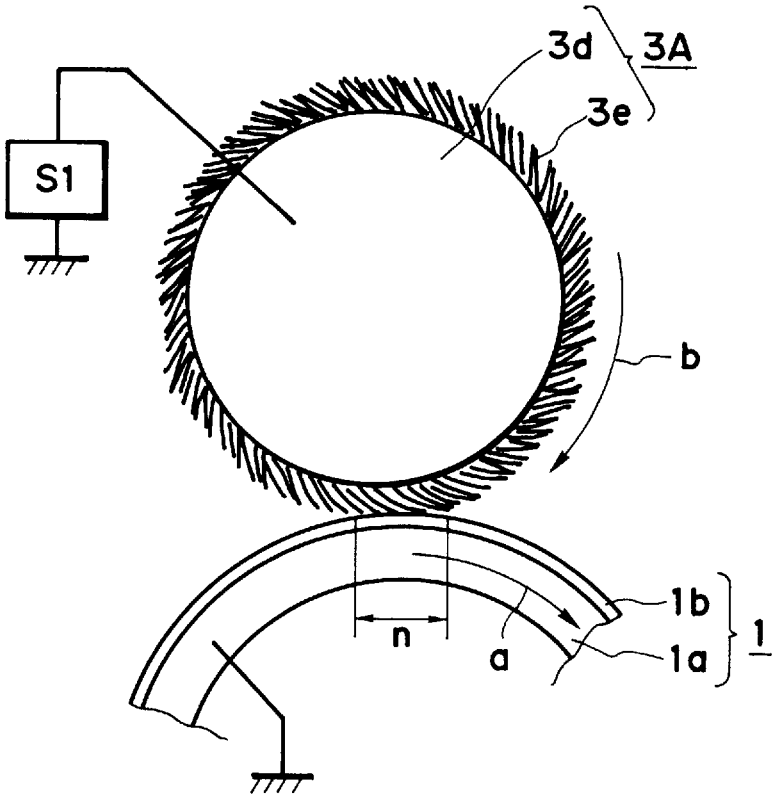
FIG. 9 is a schematic section of the essential portion (fur brush portion) of the image forming apparatus in the second embodiment of the present invention.
Figure 10:
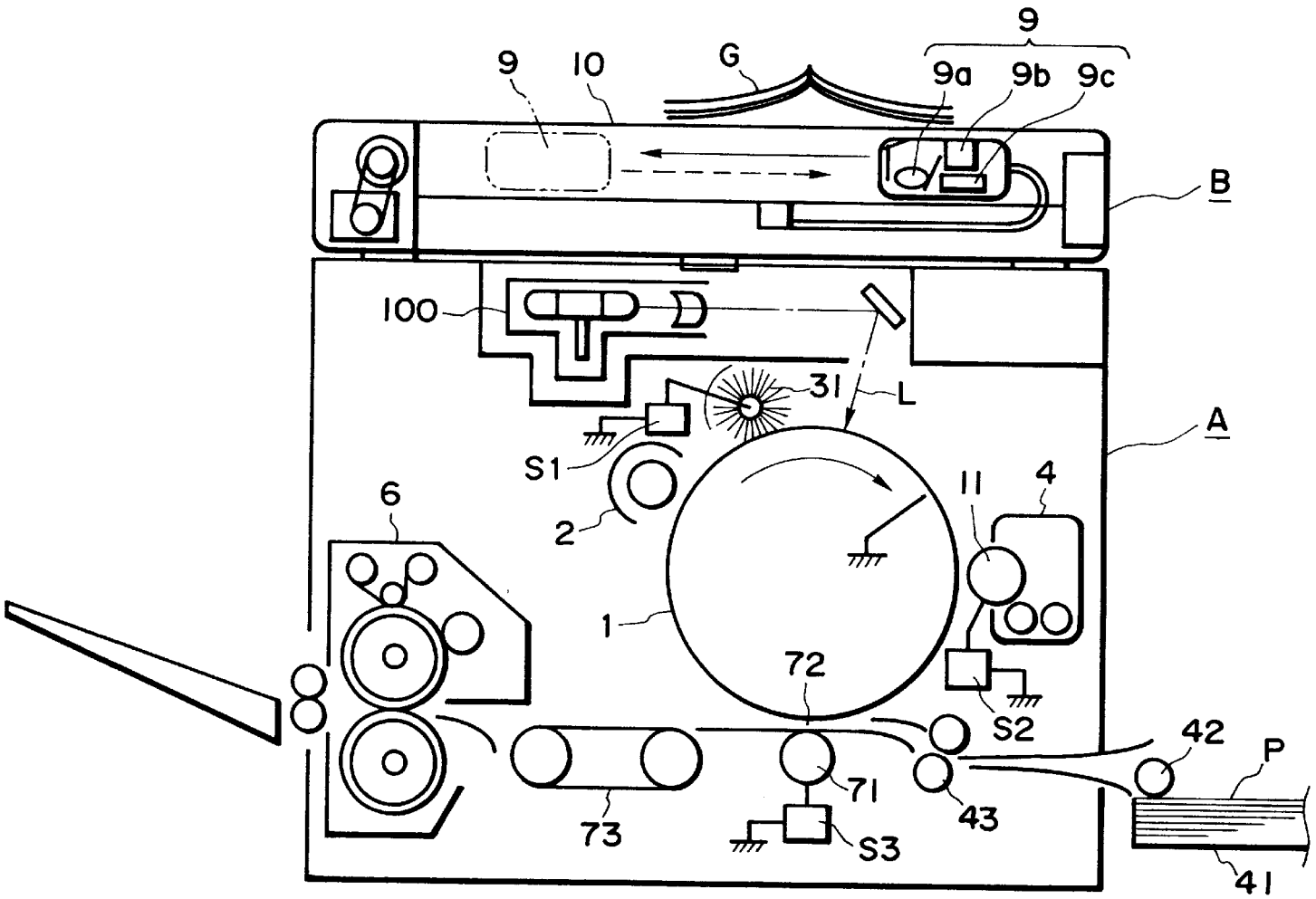
FIG. 10 is a schematic section of the image forming apparatus in the fourth embodiment of the present invention.

<Embodiment 2> (FIG. 9)

The image forming apparatus in this embodiment is similar to the one described in the first embodiment except that a fur brush made of electrically conductive bristles is employed as the contact charging member in place of the magnetic brush 3. The portions other than the fur brush are the same as those of the apparatus in the first embodiment, and therefore, their descriptions are omitted to avoid repetition of the same descriptions.

FIG. 9 is a schematic section of the fur brush 3A.

The fur brush 3A in this embodiment comprises a metallic roller 3*d* as the core of the brush having an external diameter of 10 mm, and a set of 3 mm long electrically conductive bristles planted on the peripheral surface of the metallic roller 3*d* in the manner to form a brush, at a density of 100,000 bristles per square inch. The resistance value of the bristle is $1\times10^6\Omega$. The overall external diameter of the fur brush 3A is 16 mm.

The electrically conductive bristle brush portion 3*e* of this fur brush 3A is disposed to be in contact with the surface of the photosensitive drum 1. The width of the contact nip n formed by the electrically conductive bristle brush portion 3*e* and the photosensitive drum 1 is 7 mm. This fur brush is rotated in the direction opposite to the rotational direction of the photosensitive drum 1, at a peripheral velocity of 200 mm/sec. The photosensitive drum 1 is rotated at a peripheral velocity of 100 mm/sec.

As the fur brush 3A is rotatively driven while a predetermined charge bias is applied to the fur brush 3A from the charge bias application power source S1, the surface of the photosensitive rotary drum 1 is rubbed by the electrically conductive bristle brush portion 3*e* to which the charge voltage is applied, whereby the surface of the photosensitive layer 1*b* of the photosensitive drum 1 is uniformly charged (primary charge) to a desired potential; the photosensitive drum 1 is charged using the charge injection system.

The fur brush 3A does not have the same harmful effect as the magnetic brush 3; it does not happen that the magnetic particles forming the magnetic brush layer 2 drop out and harmfully affect the developing apparatus 4. However, in the case of the fur brush 3A, the electrically conductive bristle brush portion 3*e* is invaded by toner, which causes the charging performance of the fur brush 3A to decline, causing thereby nonuniform charge. As a result, inferior images are formed.

Also in this embodiment, the same arrangement as that in the first embodiment is made. In other words, while no image is formed, alternating voltage is not applied to the fur brush 3A, and instead, only DC voltage is applied. As a result, the toner is satisfactorily expelled from the charging member, that is, the fur brush 3A, while no image is formed. Therefore, the fur brush 3A is prevented from becoming contaminated by the toner. As is evident from the foregoing paragraph, the arrangement in accordance with the present invention is possible to solve such a problem that even when alternating voltage is superposed, a satisfactory charging performance cannot be obtained. That is, the present invention can prevent an image from becoming inferior due to lack of sufficient charge capacity.

<Embodiment 3>

In the first and second embodiments, a toner t composed of toner particles produced by a pulverization method was used. In this embodiment, a toner composed of spherical toner particles produced by a suspension polymerization method and titanium oxide is used. The average particle diameter of the toner particles and titanium oxide particles are 6 $\mu$m and 20 mm, respectively. Titanium oxide is added by a weight ratio of 1%. As for the magnetic carrier, a carrier c having a saturation magnetization of 205 emu/cm$^3$ and an average particle diameter of 35 $\mu$m is used. The toner t and the carrier c are mixed by a weight ratio of 6:94 to be used as a developer T.

Since the toner particle produced by a polymerization method has a nearly spherical shape, additive can be uniformly coated thereon, which makes the toner particle easily separable from the photosensitive member 1. For example, when transfer efficiency (amount of toner transferred onto transfer sheet per unit area/amount of toner per unit area on photosensitive drum) was compared between the aforementioned pulverization toner and the polymerization toner, the former displayed an efficiency of 90%, whereas the latter displayed a much higher efficiency of 97%. In addition, the polymerization toner is preferable to the pulverization toner in terms of fog. When the polymerization was employed, fog could be prevented even when $V_{back}$ was 50 V.

When experiments similar to the first and second embodiments were conducted using the polymerization toner, the amount of the post-transfer residual toner was extremely small. In addition, even when the image forming apparatus employed in the experiments had a cleaner-less structure, being not provided with any specific cleaning apparatus, recovery efficiency was improved due to the highly separative properties of the polymerization toner, perfectly preventing the formation of the defective images. Further, when only DC voltage was applied according to the present invention while no image was formed, the highly separative properties of the polymerization toner made the pulverization toner superior in separativity from the charge carrier, and therefore, the polymerization toner having mixed into the charging member was more preferably expelled than the pulverization toner having mixed into the charging member. Therefore, it was possible to reduce the time necessary for applying DC voltage alone.

As is evident from the foregoing paragraph, when the toner produced using a polymerization method is employed as it is in this embodiment, the prevention of charging member contamination caused by toner, and accomplishment of charge uniformity, which are the effects of the present invention, can be realized at the same time, by providing a short period in which the superposing application of alternating voltage is halted, or the amplitude of alternating voltage is reduced in comparison to that of alternating voltage applied while an image is formed.

Next, miscellaneous embodiments of an image forming apparatus in accordance with the present invention will be described.

<Embodiment 4> (FIGS. 4, 5, 7, 10 and 13)

(1) General Structure of Image Forming Apparatus

FIG. 1 is a schematic section of an image forming apparatus in accordance with the present invention. The image forming apparatus in this embodiment is a laser beam printer employing a transfer type electrophotographic process. It is also an apparatus employing a contact type charging device as a charging means for an image bearing member, and a so-called cleaner-less system, in which cleaning is done at the same time as developing, by a developing means.

An alphabetic reference A designates a laser beam printer, and B designates an image scanner mounted on the printer.

(a) Image Scanner B

In the image scanner B, a reference numeral 10 designates a fixed plate glass on which an original G is to be placed. The original G is placed on the top side of this original placement glass plate, with the side to be copied facing downward, and an unillustrated plate for pressing the original is placed on the original.

A reference numeral 9 designates an image scanner unit comprising a lamp 9*a* for illuminating the original, a short focal distance lens array 9*b*, a CCD sensor 9*c*, and the like. As an unillustrated copy button is depressed, this unit 9 is driven from the home position located at the right-hand end of the glass, which is indicated by a solid line, toward the left-hand end, following the bottom surface of the original placement glass plate 10, and after it reaches a predetermined ending point of the forward movement, it is driven backward to the starting point.

While the unit 9 is moved forward, the downward facing image surface of the original G placed on the original placement glass plate 10 is sequentially illuminated in a scanning manner from the right-hand end to the left-hand end by the original image illuminating lamp 9*a* of the unit 9. The scanning light reflected from the surface of the original is focused by the short focal distance lens array 9*b* to form an image on the CCD sensor 9*c*.

The CCD sensor 9*c* comprises a light receiving portion, a transfer portion, and an output portion. A light signal is converted into an electric charge signal in the light receiving portion, and is sequentially transferred to the output portion in synchronism with a clock pulse by the transfer portion. In the output portion, the electric charge signal is converted into a voltage signal, and then, the voltage signal is amplified and outputted after impedance reduction. The thus obtained analog signal is converted into a digital signal through a known image processing operation, and this digital signal is sent to a printer A.

In other words, the image data of the original G are read as sequential electric digital picture element signals (image signals) by the image scanner B.

(b) Printer A

In the printer A, a reference numeral 1 designates an electrophotographic photosensitive member (photosensitive drum), as the image bearing member, in the form of a rotary drum. The photosensitive drum 1 is rotatively driven about the central supporting axis at a predetermined peripheral velocity (150 mm/sec in this embodiment) in the clockwise direction indicated by an arrow mark. While the photosensitive drum 1 is rotated, it is first exposed by the aforementioned exposure lamp 9*a* to remove charge, and then, uniformly charged to a predetermined polarity (approximate −600 V, in this embodiment) by a charging means 31. The charging means in this embodiment is a fur brush type charging device, which is a contact type charging means. To this fur brush type charging means, a predetermined charge bias (oscillating voltage composed by superposing an AC voltage and a DC voltage) is applied from charge bias application power source S1.

The uniformly charged surface of the photosensitive rotary drum 1 is exposed to a scanning laser beam L projected from a scanning laser portion (laser scanner), wherein this laser beam has been modulated with the image signal sent to the printer A from the image scanner B. As a result, an electrostatic latent image, which corresponds to the image data of the original G photoelectrically read by the image scanner, is formed from one end to the other on the surface of the photosensitive rotary member 1.

The electrostatic latent image formed on the surface of the photosensitive rotary drum 1 is developed into a toner image by a developing means 4, from one end to the other. The development process employed in this embodiment is the reversal development process. An alphanumeric reference S2 designates a power source for applying a predetermined development bias (alternating voltage+DC voltage) to the development sleeve 11.

Meanwhile, transfer materials P stored in a sheet feeder cassette 41 are sent out one by one by a sheet feeder roller 42, and is delivered to a transfer station 72 by a registration roller 43 with a predetermined control timing. The transfer station is constituted of the contact nip formed by the photosensitive drum 1 and the transfer roller 71. To the transfer roller 71, a transfer bias having a polarity opposite to that of the toner is applied with a predetermined control timing, whereby the toner image on the surface of the photosensitive drum 1 is electrostatically transferred onto the surface of the transfer material P.

The transfer material P onto which the toner image has been transferred during its passage through the transfer station 72 is separated from the surface of the photosensitive drum 1 from one end to the other, and is sent to a fixing apparatus 6 by a conveying apparatus 73 in the fixing apparatus 6, the toner image is thermally fixed to the transfer material P. Thereafter, the transfer material with the fixed toner image is discharged as a copy or a print from the image forming apparatus.

After the toner image transfer onto the transfer material P, the surface of the photosensitive rotary drum 1 is repetitively used for the following image formation.

(2) Photosensitive Drum 1

As for the photosensitive drum 1 as the image bearing member, an ordinarily used organic photosensitive member or the like may be employed. However, a photosensitive member comprising an organic photosensitive layer and a surface layer composed of a material having a low resistance value, an amorphous silicon photosensitive member, or the like, which has a low surface resistance of $10^9$ –$10^{14}$ Ω.cm, may be preferably employed, since they can be charged using the charge injection method, and therefore, are effective to prevent ozone generation. Further, they can improve charge characteristic.

In this embodiment, electrically conductive particles (SnO2) are dispersed in the surface layer of the organic photosensitive member to form a charge injection layer, which made the surface resistance of the photosensitive drum approximately $10^{13}$ Ω.cm.

(3) Laser Scanner Portion 100

The Laser scanner portion in this embodiment has the same structure and operates in the same manner as the one illustrated in FIG. 4, and therefore, the description is omitted.

(4) Fur Brush Type Charging Device 31

The fur brush type charging device 31 is placed in contact with the photosensitive drum 1 by the fur brush composed of electrically conductive bristles. It is rotated in such a manner that its rotational direction in the contact nip opposes that of the photosensitive drum 1. In this embodiment, the peripheral velocity of the photosensitive drum 1 is 150 mm/sec, whereas the peripheral velocity of the fur brush type charging device 31 is rotated at the peripheral velocity of 300 mm/sec.

Charge uniformity tends to improve in proportion to the peripheral velocity. Also, charge uniformity improves in proportion to the bristle density of the fur brush. Preferable charge uniformity is accomplished when the bristle density is no less than 10,000/inch$^2$.

Figure 11:
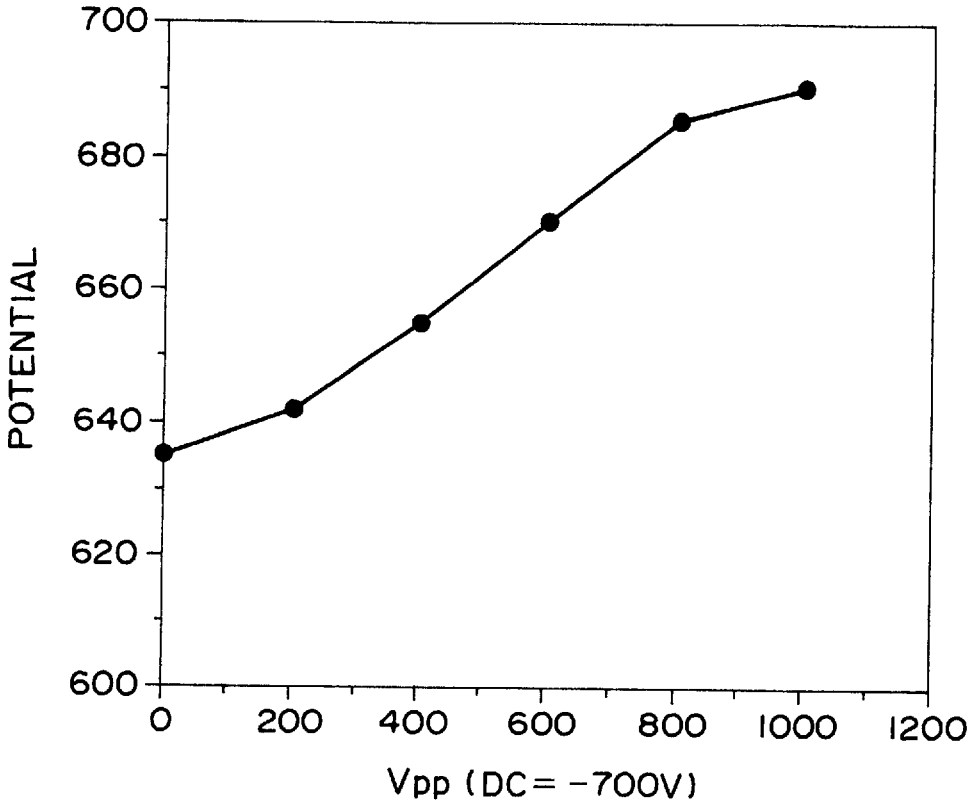
FIG. 11 is a graph showing the relationship between the alternating voltage applied to a fur brush type charging device and the resulting charge potential level.

The relationship between the amplitude of the AC component in a bias applied to the charging device 31 and the charge potential level reached after the first rotation is shown in FIG. 11. As the amplitude of the AC voltage is increased, the difference between the applied DC bias and the charge potential level reached after the first rotation decrease, whereby charge uniformity improves.

In this embodiment, a bias composed of a DC voltage of −700 V and an AC voltage superposed thereon was applied to the charging device 31, whereby a preferable level of charge uniformity was accomplished. The AC voltage had a frequency of 1,000 Hz and a peak-to-peak voltage of 1,000 V.

(5) Developing Device 4

The developing device 4 in this embodiment is the same in structure and operation as the one illustrated in FIG. 5, and therefore, the description will be omitted.

(6) Transferring Means

The transferring means in this embodiment is constituted of a transfer roller 71, which is placed in contact with the photosensitive drum 1 in a predetermined manner to form a pressure nip as the transfer station 72.

The transfer roller 71 in this embodiment comprises a core and an electrically conductive elastic layer. The core has an external diameter of 8 mm, and is made of electrically conductive rigid material such as metal. The electrically conductive elastic layer has an external diameter of 16 mm, and is formed of foamed elastic material such as foamed urethane, foamed EPDM (ethylene propylene dimethyl rubber), and the like. The resistance value of the elastic layer is adjusted to be in a range of $10^5$ –$10^{10}$ Ω.cm, by dispersing electrically conductive particles such as carbon particles in the elastic material, and the hardness (ASKER scale C) of the elastic material is adjusted to be in a range of 20°–50°. During a transfer operation, a DC voltage of approximately +4 kV is applied as the transfer bias to the metallic core of the transfer roller from a transfer bias application power source S3. As a result, a transfer electric field is generated between the photosensitive drum 1 and the transfer roller 71 in such a manner that the negatively charged toner particles constituting a toner image are transferred onto a transfer material P by the electric field. As a result, the toner image is electrostatically transferred onto the transfer material P.

(7) Cleaning Concurrent with Developing

After the toner image transfer onto the transfer material P, a certain amount of toner remains on the surface of the photosensitive drum 1. The printer in this embodiment does not have a dedicated cleaner (cleaning apparatus) for removing this post-transfer residual toner. In other words, it is a cleaner-less apparatus employing a system in which the developing device 4 concurrently doubles as the cleaner to remove the residual toner.

The charge polarity of the post-transfer residual toner is frequently reversed in charge polarity due to the separation discharge which occurs during a transfer operation. The toner reversed in polarity cannot be concurrently recovered by the developing device 4 when a latent image is developed by the developing device 4.

As the photosensitive member 1 rotates, the post-transfer residual toner particles reach the charging region of the charging device 31. As the residual toner particles reach the charging region, the toner particles having been reversed in polarity (positively charged toner particles) are converted into normally charged toner particles by the friction which occurs between the particles and the brush of the fur brush type charging device 31. At the same time, the toner particles are expelled from the charging device by the oscillatory effect of the electric field which is generated between the photosensitive drum 1 and the charging device 31 by the alternating voltage; the toner particles having been converted into normally charged toner particles are expelled onto the surface of the photosensitive drum. Then, the toner recovery from the surface of the photosensitive drum 1 and the latent image development concurrently occurs in the developing portion. The problem which occurs during this operation is contamination of the charging device. When a large amount of toner invades the fur brush type charging device 31, charge uniformity sometimes decreases even if alternating voltage is superposed.

Figure 12A:
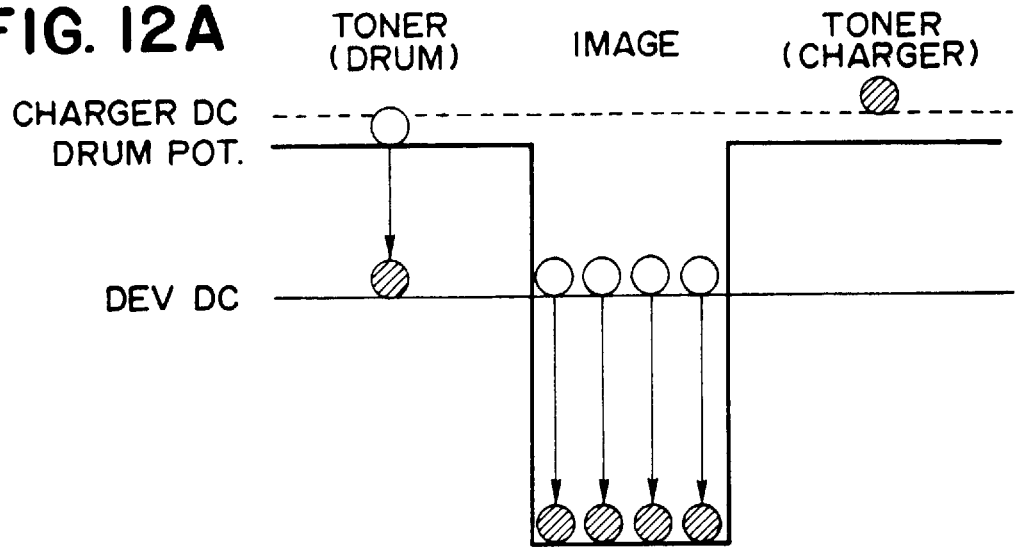
FIGS. 12*a*, 12*b* and 12*c* are schematic drawings depicting the relationship between the voltage charged during a charging process, and the resulting charge potential level, in conduction with the movement of the toner on a photosensitive drum an the movement of the toner mixing into the charging device.
Figure 12B:
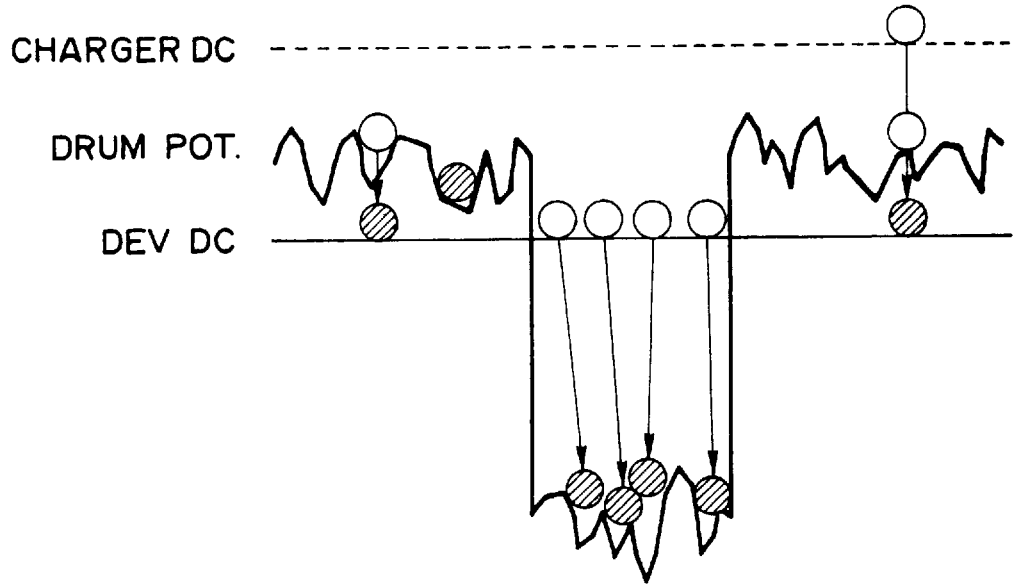
Figure 12C:
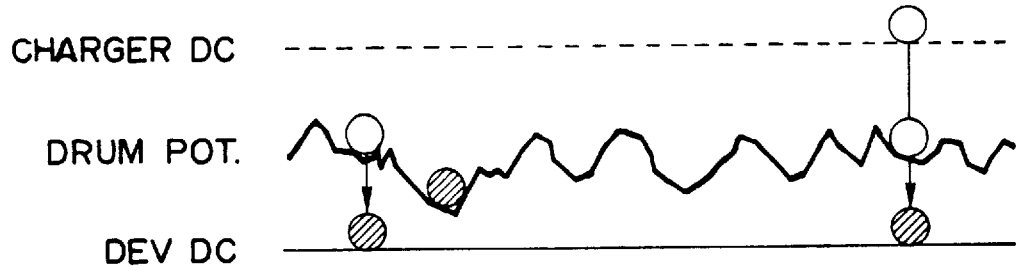

FIG. 12 shows the relationship between the DC current applied to the charging device 31 during a charging operation, and the obtained potential level, in conjunction with the movements of the toner particles on the photosensitive drum 1 and the toner particles having invaded the charging device. FIG. 12(*a*) depicts a case in which alternating voltage is superposed during image formation; FIG. 12(*b*), a case in which DC voltage alone is applied during image formation; and FIG. 12(*c*) depicts a case in which DC voltage alone is applied to charge a photosensitive member. In the case of 12(*a*) in which alternating voltage is superposed, charging efficiency is good enough to create a sufficient voltage difference between the drum potential and the development sleeve potential to recover the toner on the photosensitive drum 1 into the developing device, but difference between the value of the DC voltage applied to the charging member and the value of the obtained potential is small; therefore, the amount by which the toner particles having invaded the charging member are expelled onto the photosensitive drum 1 decreases. In the case of 12(*b*) in which DC voltage alone is applied, charging efficiency is inferior, allowing the difference between the value of the DC voltage applied to the charging member and the value of the obtained potential to increase; therefore, the amount by which the toner particles having invaded the charging member are expelled onto the photosensitive drum 1 increases. However, since charging efficiency is inferior, a voltage difference sufficient to recover the toner on the photosensitive drum 1 into the developing device cannot be created between the drum potential and the development sleeve potential, and also, nonuniformity of charge adversely affects image formation. In other words, applying only nC voltage during image formation leads to creation of an image flaw. Therefore, it is preferable to superpose alternating voltage as depicted in FIG. 12(*a*).

Figure 13A:
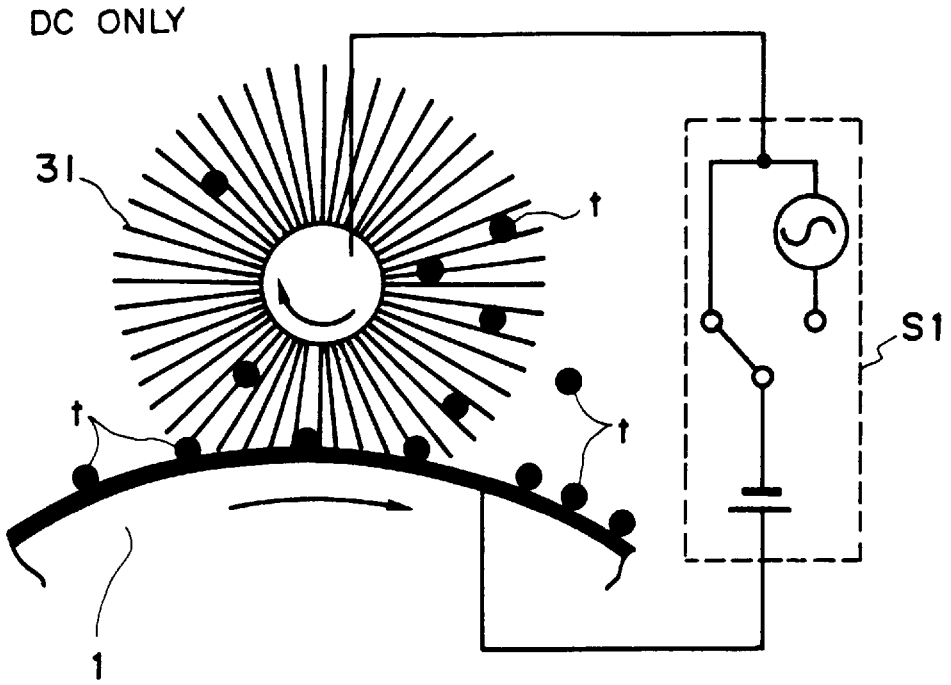
FIGS. 13*a* and 13*b* are schematic drawings depicting the toner movement which occurs when a bias is applied to a fur brush type charging device.
Figure 13B:
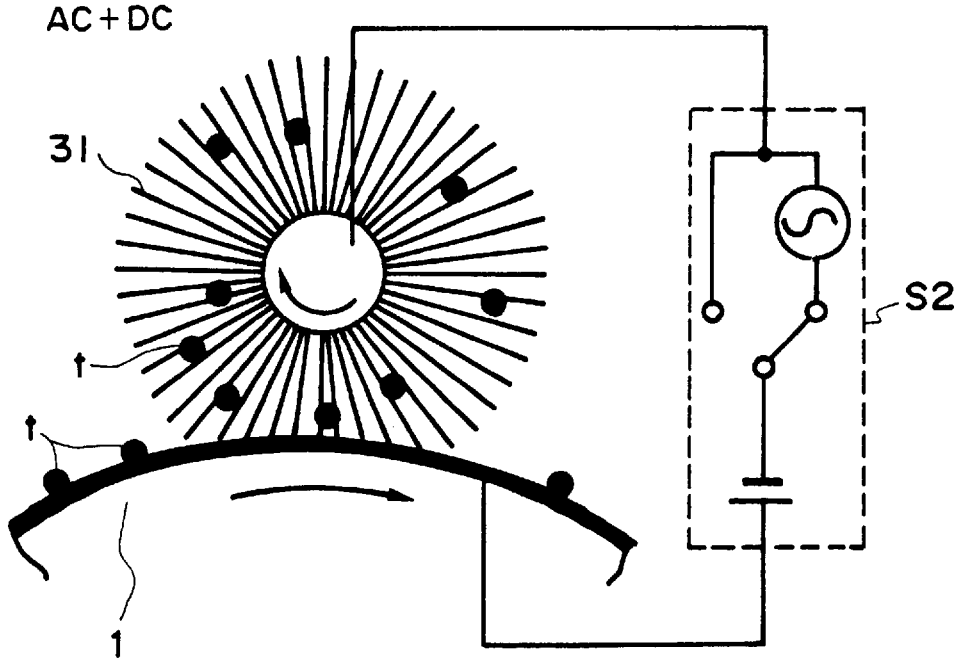

Thus, in this embodiment, while no image is formed (when a certain region of the image bearing member surface, which is to become the region on which no image is formed, is at the charging position), toner t adhering to the charging device is transferred onto the surface of the photosensitive drum 1 by creating a period in which alternating voltage is not superposed and DC voltage alone is applied as depicted in FIG. 13(*a*). While an image is formed, alternating voltage is superposed as depicted in FIG. 13(*b*) to accomplish charge uniformity and recover the toner particles on the photosensitive member 1 by the developing device. In other words, charging device contamination is prevented since the toner particles adhering to the charging device 31 are expelled by applying only DC voltage, and the toner particles expelled onto the surface of the photosensitive member 1 are aggressively recovered into the developing device by applying alternating voltage.

More specifically speaking, voltage is applied using a timing such as the one illustrated in FIG. 7. In other words, first, with the provision of a period in which only DC voltage is applied to the charging device before an actual image formation, the toner t on or in the fur brush 31 is expelled onto the photosensitive drum 1, as depicted in FIG. 13(*a*), and is recovered by the developing device 4 as much as possible. Immediately afterward, the surface of the photosensitive drum 1 is uniformly charged by superposing alternating voltage, as depicted in FIG. 13(*b*), whereby the toner particles on the photosensitive drum 1 are aggressively recovered into the developing device 4. Then, an image is formed while applying alternating voltage. Therefore, an image forming process is always carried out without brush contamination, which makes it possible to continuously produce preferable images.

As is evident from the above, controlling the bias applied to the charging device 31 while no image is formed mares it possible to prevent the contamination of the charging device 31 while uniformly charging the photosensitive member 1.

In this embodiment, the toner t on the fur brush 31 is uniformly expelled onto the photosensitive drum 1 by providing a period, in which only DC voltage is applied, in the period in which no image is formed. However, it is unnecessary to completely interrupt the application of alternating voltage. Instead, the amplitude of alternating voltage may be reduced while no image is formed, compared to while an image is formed; for example, it may be reduced to 200 V. It was confirmed that when the amplitude of alternating voltage was reduced as described above, charging capacity decreased as illustrated in FIG. 11, and therefore, the effect of expelling the toner out of the charging device could be realized.

Figure 14A:
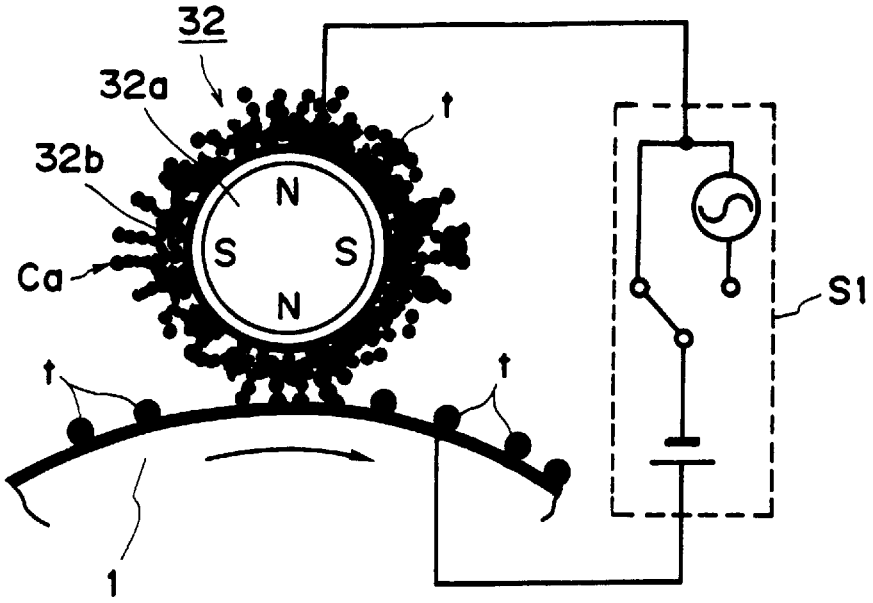
FIGS. 14*a* and 14*b* are is a schematic drawings depicting the toner movement which occurs when a bias is applied to a magnetic brush type charging device.
Figure 14B:
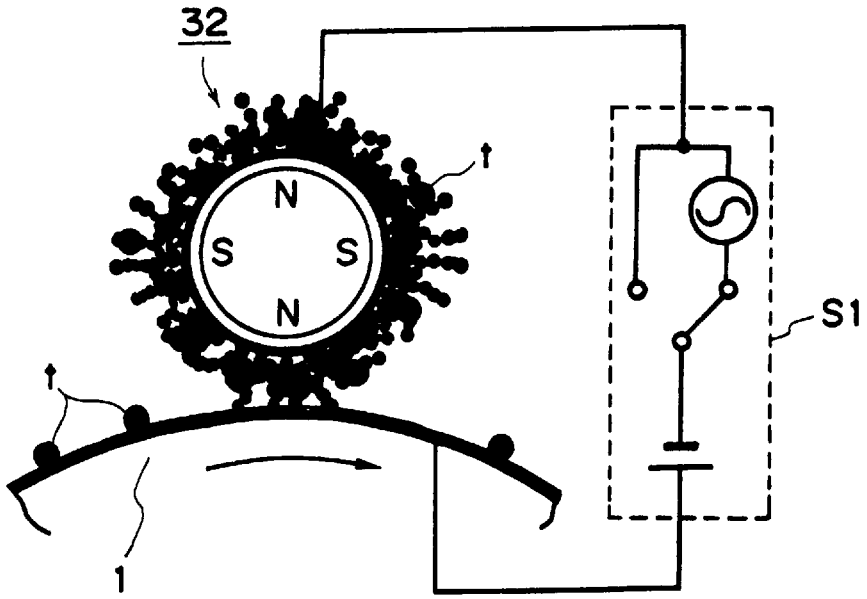
Figure 15A:
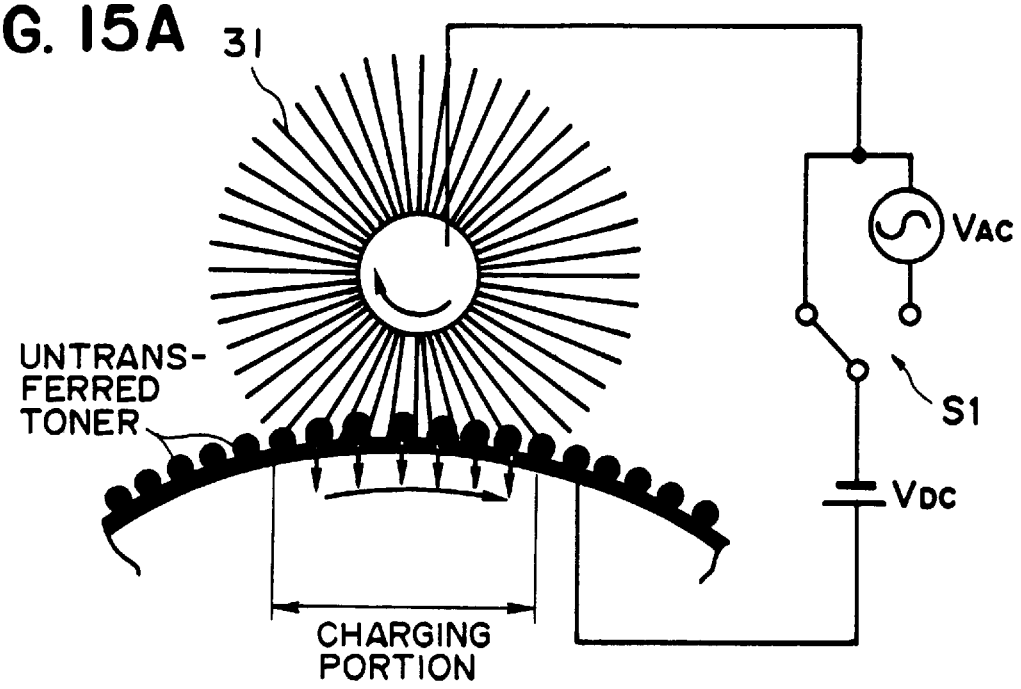
FIGS. 15*a* and 15*b* are schematic drawings depicting the force which acts on the post-transfer residual toner on a photosensitive drum when a DC voltage is applied to a fur brush type charging device, in conjunction with the movement of the toner caused by the force.
Figure 15B:
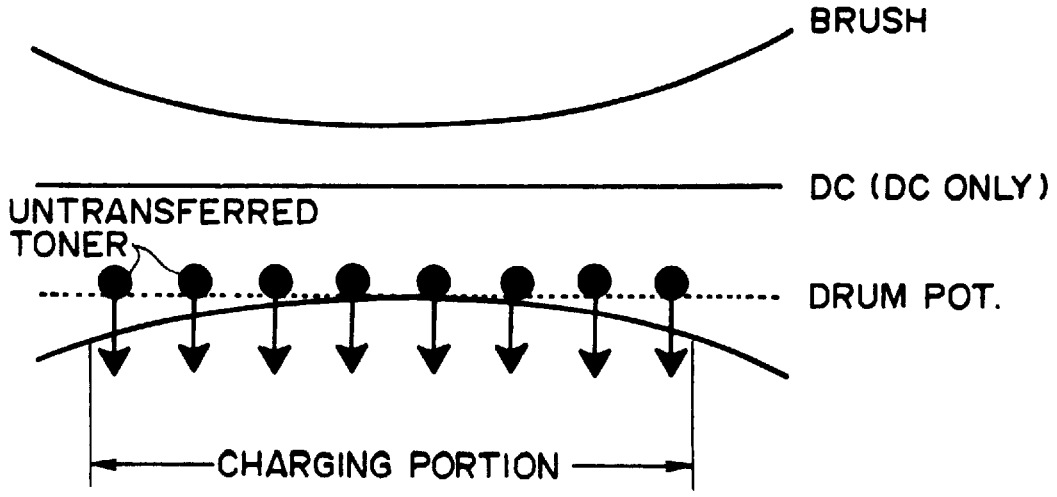
Figure 16A:
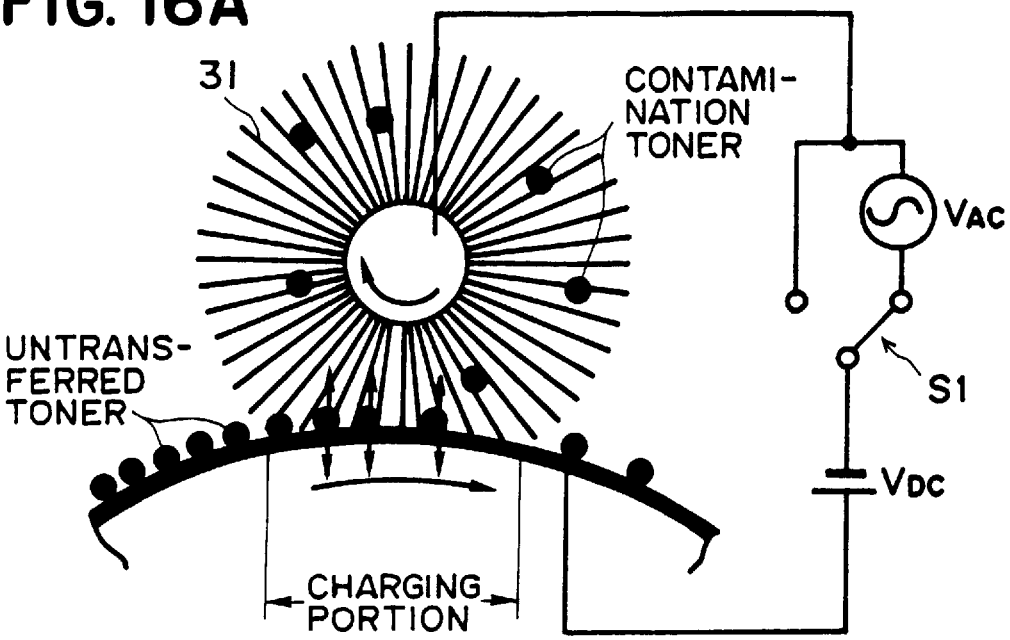
FIGS. 16*a* and 16*b* are schematic drawings depicting the force which acts on the post-transfer residual toner on a photosensitive drum when a bias comprising an AC voltage is applied to a fur brush type charging device, in conjunction with the movement of the toner caused by the force.
Figure 16B:
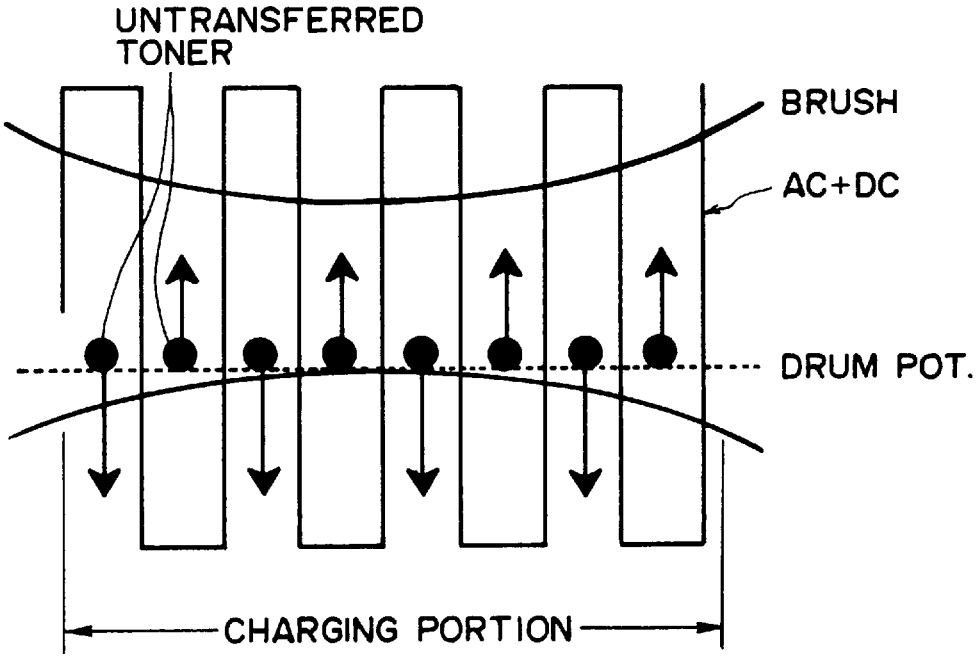

<Embodiment 5>(FIGS. 3 and 14)

In this embodiment, the same printer as the one in the preceding fourth embodiment is employed, except that the fur brush type charging device 31 as the charging means for the photosensitive drum 1 is replaced with a magnetic brush type charging device 32 illustrated in FIG. 14; rest of the structures are the same as those in the embodiment 4. In FIG. 14, the relationship in terms of particle diameter size between the toner t and the magnetic particle Ca is reversed for schematization; it is opposite to the actual relationship.

The magnetic brush type charging device 32 employed in this embodiment comprises fixed magnet 32*a*, a nonmagnetic sleeve 32, and magnetic particles (magnetic carrier) Ca. The sleeve 3*b* has an external diameter of 20 mm, and is rotatively fitted around the fixed magnet 32*a*. The magnetic particles Ca are clustered in the form of a brush by the magnetic field, on the peripheral surface of the nonmagnetic sleeve 32*b*, and are in contact with the peripheral surface of the photosensitive member 1, by the tip portion of the brush. As the nonmagnetic sleeve 32*b* rotates, the magnetic particles Ca are conveyed. The nonmagnetic sleeve 32*b* rotates in the direction opposite to the rotational direction of the photosensitive member 1. In this embodiment, the peripheral velocity of the photosensitive drum 1 is 150 mm/sec, whereas the nonmagnetic sleeve 32*b* is rotated at a peripheral velocity of 225 mm/sec.

As charge voltage is applied to the nonmagnetic sleeve 32*b* from an electric power source S1, potential is given to the surface of the photosensitive drum 1 through the magnetic particles Ca, and as a result, the surface of the photosensitive drum 1 is charged to a potential level corresponding to the charge voltage. As for the peripheral velocity, charge uniformity tends to improve in proportion to the velocity. However, in the case of the aforementioned magnetic brush type charging system, the state of contact in terms of density is much better than in the case of the fur brush type charging system; therefore, it is possible to slightly reduce the peripheral velocity. As for the magnetic particles Ca used in the charging device 32, those having an average particle diameter range of 10–100 $\mu$m, a saturation magnetization range of 20–250 emu/cm$^3$, and a resistance range of $10^2$–$10^{10}$ Ω.cm are preferable. In this embodiment, magnetic particles of ferrite is employed, which have an average particle diameter of 25 μm, a saturation magnetization of 200 emu/cm$^3$, and a resistance is $5\times10^6$ Ω.cm. As for the resistance value of the magnetic particle, two grams of magnetic particles is placed in a metallic cell having a bottom size of 228 mm$^2$, and is packed applying a weight of 6.6 kg/cm$^2$. Then, the resistance is measured while applying a voltage of 100 V.

FIG. 3 shows the relationship between the amplitude of the bias applied to the charging device 32, and the obtained potential level after the first rotation. As the amplitude of the alternating voltage is increased, the difference between the DC bias and the potential level after the first rotation becomes smaller, resulting in more preferable charge uniformity. In this embodiment, a preferable charge characteristic was realized by applying to the charging device 32, a bias composed of a DC voltage and an alternating voltage superposed thereon. The DC voltage was −700 V, and the alternating voltage had a frequency of 1,000 Hz and a peak-to-peak voltage of 1,000 V.

The magnetic brush type charging device 32 is more tolerant of contamination than the fur brush type charging device 31. However, even in the case of the magnetic brush type charging device 32, when it is invaded by a large amount of toner particles, charge uniformity sometimes decreases in spite of the superposition of alternating voltage.

Therefore, in this embodiment, toner t adhering to the charging device 32 is transferred onto the surface of the photosensitive drum 1 by creating a period, in which alternating voltage is not superposed and DC voltage alone is applied as depicted in FIG. 14(*a*), within the period in which no image is formed. While an image is formed, alternating voltage is superposed as depicted in FIG. 14(*b*) to accomplish charge uniformity and recover the toner particles on the photosensitive member 1. In other words, charging device contamination is prevented since the toner particles adhering to the charging device 32 are expelled by applying only DC voltage, and the toner particles are aggressively recovered by applying alternating voltage.

More specifically speaking, voltage is applied using a timing such as the one illustrated in FIG. 7. In other words, first, with the provision of a period in which only DC voltage is applied before an actual image formation, the toner t in the magnetic brush 32 is uniformly expelled onto the photosensitive drum 1, as depicted in FIG. 14(*a*), and is recovered by the developing device 4 as much as possible. Immediately afterward, the surface of the photosensitive drum 1 is uniformly charged by superposing alternating voltage, as depicted in FIG. 14(*b*), whereby the toner particles on the photosensitive drum 1 are aggressively recovered into the developing device 4. Then, an image is formed while applying alternating voltage. Therefore, an image forming process is always carried out without brush contamination, which makes it possible to continuously produce preferable images.

As is evident from the above, controlling the bias applied to the charging device 32 while no image is formed makes it possible to prevent the contamination of the charging device 32 while uniformly charging the photosensitive member 1.

In this embodiment, the toner t on the magnetic brush 32 is uniformly expelled onto the photosensitive drum 1 by creating a period, in which only DC voltage is applied, within the period in which no image is formed. However, it is unnecessary to completely interrupt the application of alternating voltage. Instead, the amplitude of alternating voltage may be reduced while no image is formed, compared to while an image is formed; for example, it may be reduced to 200 V. It was confirmed that when the amplitude of alternating voltage was reduced as described above, charging capacity decreased as illustrated in FIG. 3, and therefore, the effect of expelling the toner out of the charging device could be realized.

Further, this embodiment was described with reference to a system in which a nonmagnetic sleeve fitted around a magnetic roller is rotated. However, application of the present invention is not limited to this structure. For example, even in the case of a system which has substantially the same structure as the above except that the magnet rotates, or a system which comprises only a magnet roller and in which the magnet roller itself rotates, the same effects as those described above can be obtained, as long as the surface of the roller is given electrical conductivity.

<Embodiment 6>

In the fourth and fifth embodiments, toner particles produced by a pulverization method were used as the toner particles t in the developer. In this embodiment, spherical toner particles produced by a suspension polymerization method are used. They have an average particle diameter of 6 μm, and to this toner, titanium oxide particles having an average particle diameter of 20 nm are added by a weight percent of 1%. As for the magnetic carrier c, magnetic carrier having a saturation magnetization of 205 emu/cm$^2$ and an average particle diameter of 35 μm are used. The thus prepared toner t is mixed with the carrier c at a weight ratio of 6:94 to be used as developer.

Since the toner particle produced by a polymerization method has a nearly spherical shape, additive can be uniformly coated thereon, which makes the toner particles easily separable from the photosensitive member 1. For example, when transfer efficiency (amount of toner transferred onto transfer sheet per unit area/amount of toner per unit area on photosensitive drum) was compared between the aforementioned pulverization toner and the polymerization toner, the former displayed an efficiency of 90%, whereas the latter displayed a much higher efficiency of 97%. In addition, the polymerization toner is preferable to the pulverization toner in terms of fog. When the polymerization toner was employed, fog could be prevented even when $V_{back}$ (potential difference between the DC voltage applied to the development sleeve and the dark portion potential of the photosensitive drum) was 50 V.

When experiments similar to the first and second embodiments were conducted using the polymerization toner, the amount of the post-transfer residual toner was extremely small. In addition, when the image forming apparatus employed in the experiments had a cleaner-less structure, being not provided with any specific cleaning apparatus, recovery efficiency was improved due to the highly separative properties of the polymerization toner, perfectly preventing the formation of the defective images.

Further, when only DC voltage was applied while no image was formed, the highly separative properties of the polymerization toner made the pulverization toner superior in separativity from the charge carrier, and therefore, the polymerization toner having mixed into the charging member was more preferably expelled than the pulverization toner having mixed into the charging member. Therefore, it was possible to reduce the time necessary for applying DC voltage alone.

As is evident from the foregoing paragraph, when the toner produced using a polymerization method is employed as it is in this embodiment, the prevention of charging member contamination caused by toner, and accomplishment of charge uniformity, which are the effects of the present invention, can be concurrently realized, by providing a short period in which the superposing application of alternating voltage is halted, or the amplitude of alternating voltage is reduced in comparison to that of alternating voltage applied while an image is formed.

<Embodiment 7> (FIGS. 4, 5, 10, 11, 15 and 16)

In this embodiment, a method for expelling toner particles from the fur brush type charging device 31 onto the photosensitive drum 1 during the re-startup of the image forming apparatus in the fourth embodiment after the operation of the image forming apparatus is interrupted due to a paper jam or the like during the developing operation or the transferring operation will be described.

The main assembly of an image forming apparatus occasionally stops during a developing operation or a transferring operation due to a paper jam caused by a sheet (transfer material) conveyance error, or the like. When this occurs, a large amount of toner which is yet to be transferred is present on the photosensitive drum 1. If the image forming apparatus in this condition is restarted after necessary processes such as removal of jammed sheets of paper, that is, if alternating voltage is applied to the fur brush type charging device 31 of the image forming apparatus in this condition, in the same manner as during the period of actual image formation, the aforementioned yet-to-be-transferred toner particles are caused to shuttle between the photosensitive drum 1 and the fur brush type charging device 31, by the oscillating electric field, in the charging portion. As a result, the fur brush type charging device 31 is contaminated with the toner.

On the other hand, in this embodiment, when the apparatus is restarted (when the power source of the apparatus is turned on again), only DC voltage (or a bias comprising an alternating voltage component having an amplitude reduced relative to the amplitude for image formation) is applied to the fur brush charging device 31 while no image is formed. In this case, the yet-to-be-transferred residual toner, which has not been given positive charge by the transfer charging device, is the toner having the normal polarity (negative polarity).

Therefore, when the toner has been normally charged, that is, when the difference between the applied bias and the obtained potential is not zero (|applied bias−obtained potential|>0), a force that moves the toner toward the photosensitive drum 1 is generated. Consequently, the amount of the yet-to-be-transferred residual toner which contaminates the fur brush charging device 31 while passing through the charging portion is extremely reduced.

Further, after passing the charging portion, the residual toner on the photosensitive drum 1 is recovered by applying to the developing device 4 a voltage lower than the voltage applied to charge the photosensitive drum, whereby the surface of the photosensitive drum 1 is satisfactorily cleaned.

In this embodiment, the toner on the fur brush of the fur brush type charging device 31 is uniformly expelled onto the photosensitive drum 1 by placing a period, in which only DC voltage is applied, ahead of the time at which the apparatus is restarted, for example, after removing the transfer material causing a problem such as a paper jam. However, it is unnecessary to completely interrupt the application of alternating voltage. Instead, the amplitude of alternating voltage may be reduced while no image is formed, compared to while an image is formed. For example, it may be reduced to 200 V to cause the toner to be attracted only toward the photosensitive drum side. It was confirmed that when the amplitude of alternating voltage was reduced as described above, charging capacity decreased as illustrated in FIG. 11, and therefore, the potential difference (|applied bias—obtained potential| for driving the toner only toward the photosensitive drum sufficiently increased to provide the toner expelling effect.

Further, it is preferable that a DC voltage alone or a bias comprising an alternating voltage component having a reduced amplitude is applied to the fur brush type charging device 31, not only at the time of restarting the image forming apparatus after a jam, but also at any normal starting time (when the main switch of the apparatus is turned on), and while the temperature of the fixing apparatus is below the standby temperature. With the provision of such an arrangement, a sufficient time can be provided for expelling the toner having invaded the fur brush type charging device 31, and recovering the expelled toner into the developing apparatus 4, and therefore, the service life of the fur brush type charging device 31 can be extended by a great length.

<Embodiment 8> (FIGS. 3 and 7)

Figure 17A:
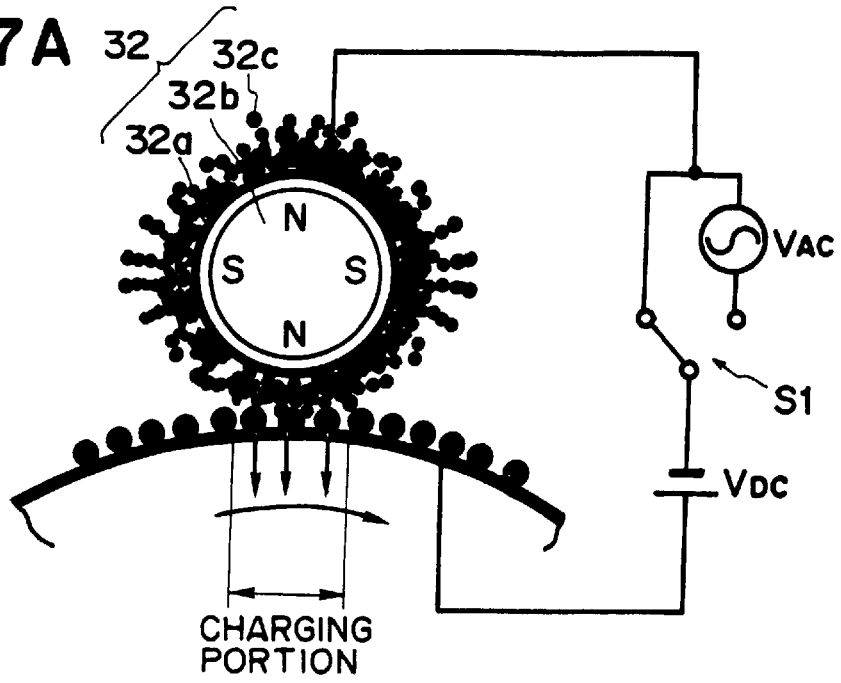
FIGS. 17*a* and 17*b* are schematic drawings depicting the force which acts on the post-transfer residual toner on a photosensitive drum when a DC voltage is applied to a magnetic brush type charging device, in conjunction with the movement of the toner caused by the force.
Figure 17B:
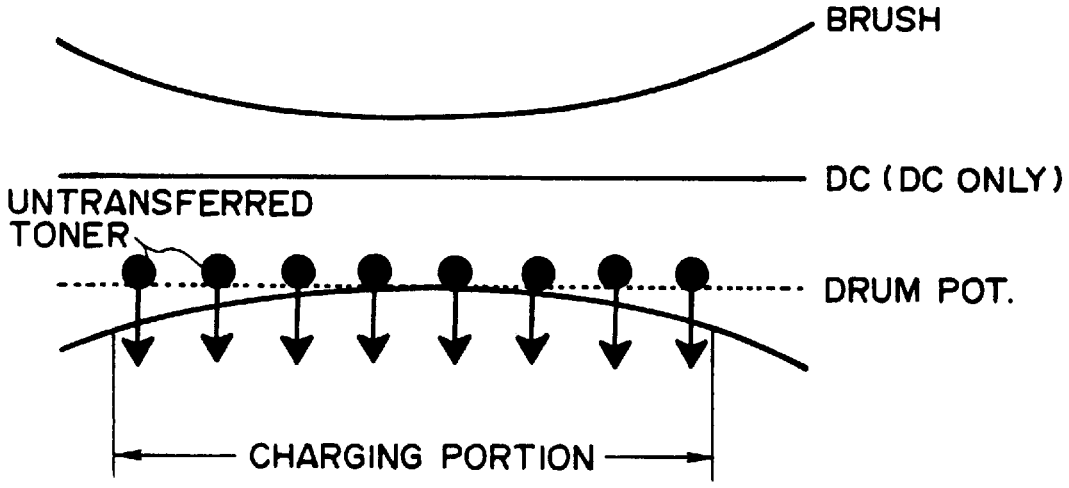
Figure 18A:
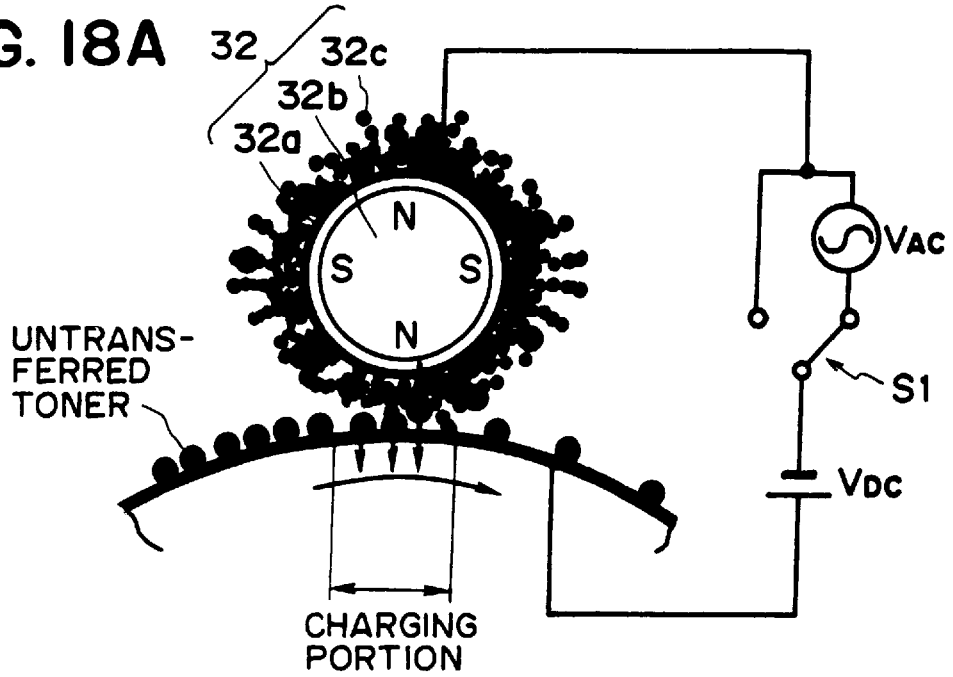
FIGS. 18*a* and 18*b* are schematic drawings depicting the force which acts on the post-transfer residual toner on a photosensitive drum when a bias comprising an AC voltage is applied to a magnetic brush type charging device, in conjunction with the movement of the toner caused by the force.
Figure 18B:
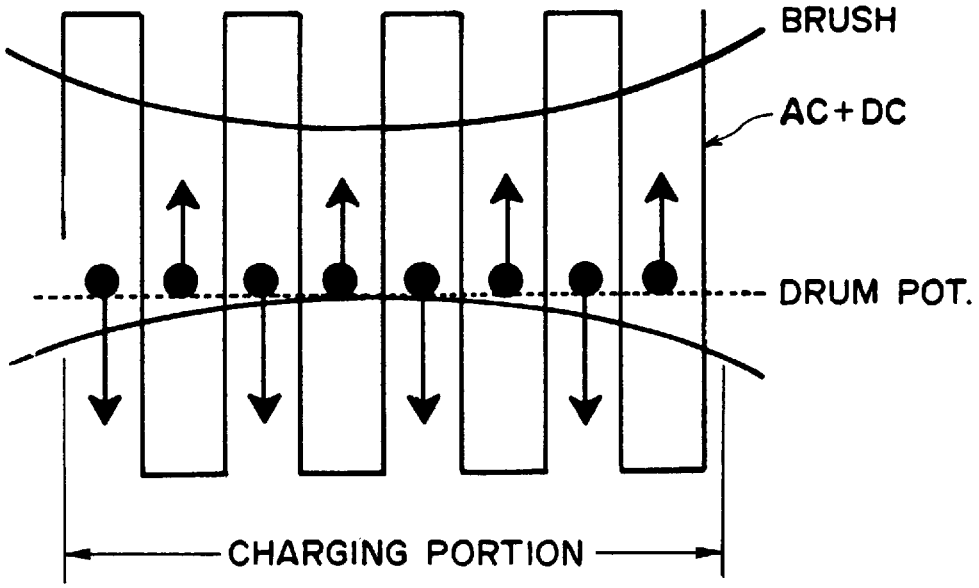

Also in this embodiment, an image forming apparatus such as the one in the fourth embodiment is employed. But, the fur brush type (contact type) charging apparatus as the charging means in the fourth embodiment is exchanged with a magnetic brush type (contact type) charging apparatus. Since the rest of the structure and the other processing devices remain the same, their descriptions will be omitted. FIGS. 17(*a*) and 18(*a*) are schematic sections of the contact type charging apparatuses employing a magnetic brush. In the drawings, a reference numeral 32 designates the magnetic brush type charging device as the contact type charging member. The relationship in terms of particle size between the toner particle and the magnetic particle is contrary to their actual relationship.

This magnetic brush type-charging device 32 comprises a nonmagnetic sleeve 32*a* having an external diameter of 20 mm, a magnetic roller 32*b* as a means for generating a magnetic field, a magnetic particle layer 32*c*, and the like. The magnetic roller 32*b* is fixedly disposed in the sleeve 32*a*, and the magnetic particle layer 32*c* is constituted of magnetic particles held on the peripheral surface of the nonmagnetic sleeve 32*a* by the magnetic force of the magnetic roller 32*b* in the sleeve 32*a*. The magnetic brush layer 32*c* is placed in contact with the surface of the photosensitive drum 1, forming a charging station.

The nonmagnetic sleeve 32*a* is rotated in such a manner that its rotational direction at the contact between the nonmagnetic sleeve 32*a* and the photosensitive member 1 becomes opposite to that of the photosensitive member 1. The peripheral velocity of the nonmagnetic sleeve 32*a* is 225 mm/sec, whereas the peripheral velocity of the photosensitive drum 1 is 150 mm/sec. As the nonmagnetic sleeve 32*a* is rotated, the magnetic brush 32*c* is moved in a manner to rub the surface of the photosensitive drum 1. Since a predetermined charge bias is applied to the nonmagnetic sleeve 32*a* of the magnetic brush type charging device 32 from a charge bias power source S1, electric charge is given to the surface of the photosensitive drum 1 through the magnetic particles, whereby the surface of the photosensitive member 1 is charged to a potential level corresponding to the applied charge voltage.

It is preferable that the magnetic particles for forming the magnetic brush 32*c* have an average particle diameter range of 10–100 $\mu$m, a saturation magnetization of 20–250 emu/cm$^3$, and an electrical resistance of $10^2$ –$10^{10}$ Ω.cm.

In this embodiment, the magnetic particles are composed of ferrite, and have an average particle diameter of 25 $\mu$m, a saturation magnetization of 200 emu/cm$^3$, and a resistance value of $5\times10^6$ Ω.cm.

As for the electrical resistance value of the magnetic particle, two grams of magnetic particles are placed in a metallic cell having a bottom size of 228 $mm^2$, and packed with the application of 6.6 $kg/cm^2$ , and the resistance value is measured while applying a voltage of 100 V.

Charge uniformity tends to improve in proportion to the peripheral velocity of the magnetic brush type charging device 32. Further, in the case of the magnetic brush based contact type charging system, the state of contact in terms of density is much better than in the case of the fur brush based contact type charging system. Therefore, it is possible to slightly reduce the peripheral velocity.

In this embodiment, the bias applied to the magnetic brush type charging device 32 is composed of a DC voltage of $V_{dc}$ and an alternating voltage $V_{AC}$ superposed thereon. The relationship between the amplitude of the alternating voltage component and the obtained potential level is shown in FIG. 3 As the amplitude of the alternating voltage is increased, the difference between the applied DC voltage and the obtained potential level becomes smaller, which improves charge uniformity. In the case of this embodiment, a preferable charge characteristic could be realized by applying to the magnetic brush type charging device 32 a DC voltage $V_{dc}$ of −700 V and an alternating voltage $V_{AC}$ having a frequency of 1,000 Hz and a peak-to-peak voltage of 1,000 V.

Also in this embodiment, the post-transfer residual toner which is delivered from the transfer station to the charging station becomes normally (negatively) charged by the friction occurring between the toner and the magnetic brush type charging device 32.

At the same time, an oscillating electric field is generated between the photosensitive drum 1 and the magnetic brush type charging device 32 by the AC voltage component of the bias applied to the magnetic brush type charging device 32, and the after transfer or post-transfer residual toner is caused to invade, or be expelled from, the magnetic brush type charging by the oscillating electric field. As a result, normally charged post-transfer residual toner is expelled onto the photosensitive drum 1, so that concurrent development and toner collection (cleaning) operations are accomplished.

Normally, even while alternating voltage is superposed on DC voltage applied to the magnetic brush type charging device 32 to charge the photosensitive drum 1, a small amount of toner is continuously expelled from the magnetic brush type charging device 32. Therefore, the amount of toner remaining mixed in the magnetic brush is kept sufficiently small to produce a preferable image.

The magnetic brush type charging device 32 is more tolerant of contamination than the fur brush type charging device 31. However, even in the case of the magnetic brush type charging device 32, when it is invaded by a large amount of toner particles, charge uniformity sometimes decreases in spite of the superposition of alternating voltage.

The main assembly of an image forming apparatus occasionally stops during a developing operation or a transferring operation due to a paper jam or the like. If alternating voltage is applied to the magnetic brush type charging device 32 of the image forming apparatus, in the same manner as during the period of actual image formation, when the apparatus is restarted after such stoppage, a large amount of the aforementioned yet-to-be-transferred toner particles are caused to shuttle between the photosensitive drum 1 and the magnetic brush type charging device 32, by the oscillating electric field, in the charging portion. As a result, the magnetic brush type charging device 32 is contaminated with the toner.

On the other hand, in this embodiment, when the apparatus is restarted, only DC voltage (or a bias comprising an alternating voltage component having a reduced amplitude) is applied to the magnetic brush type charging device 32. In this case, the yet-to-be-transferred residual toner is the toner having the normal polarity. Therefore, when the toner has been normally charged, that is, when the difference between the applied bias and the obtained potential is not zero (|applied bias—obtained potential|>0), a force that moves the toner toward the photosensitive drum 1 is generated as shown by the schematic drawing in FIG. 17. Consequently, the amount of the residual toner which contaminates the magnetic brush type charging device 32 is extremely reduced while passing through the charging station.

Further, after passing the charging station, the residual toner on the photosensitive drum 1 is recovered by applying to the developing apparatus 4 a voltage lower than the voltage applied to charge the photosensitive drum (dark portion potential), whereby the surface of the photosensitive drum 1 is satisfactorily cleaned.

In this embodiment, the toner on the magnetic brush type charging device 32 is uniformly expelled onto the photosensitive drum 1 by placing a period, in which only DC voltage is applied, immediately before the time at which the apparatus is restarted. However, it is unnecessary to completely interrupt the application of alternating voltage. Instead, in order to cause the toner to be attracted only toward the photosensitive drum side, the amplitude of alternating voltage may be reduced while no image is formed, compared to while an image is formed. For example, it may be reduced to 200 V. It was confirmed that when the amplitude of alternating voltage was reduced as described above, charging capacity decreased, and therefore, the potential difference (|applied bias—obtained potential| for driving the toner only toward the photosensitive drum sufficiently increased to provide the toner expelling effect.

Further, it is preferable that a DC voltage alone or a bias comprising an alternating voltage component having a reduced amplitude is applied to the magnetic brush type charging device 32, not only at the time of restarting the image forming apparatus after a jam, but also at any normal starting time (when the main switch of the apparatus is turned on). With the provision of such an arrangement, an ample time can be provided for expelling the toner having invaded the magnetic brush type charging device 32, and then recovering the expelled toner into the developing apparatus 4, and therefore, the service life of the magnetic brush type charging device 32 can be extended by a great length.

Further, the magnetic brush type charging device 32 in this embodiment employs a system in which a nonmagnetic sleeve 32*a* fitted around a magnetic roller 32*b* is rotated. However, the structure of the magnetic brush type charging device 32 does not need to be limited to this structure. For example, even in the case of a system which has substantially the same structure as the above except that the magnetic roller 32*b* rotates, or a system which comprises only a magnet roller and in which the magnet roller itself rotates, the same effects as those described above can be obtained, as long as the surface of the roller is given electrical conductivity.

<Embodiment 9>

The image forming apparatus employed in this embodiment is the same as those in the seventh and eighth embodiments, but the toner used in this embodiment is the toner produced using a polymerization method. The apparatus structure and control are the same as those in the seventh and eighth embodiments; therefore, their descriptions will not be repeated.

In the seventh and eighth embodiments, toner particles produced using a pulverization method were used as the toner toner particles t in developer. In this embodiment, spherical toner particles produced by a suspension polymerization method are used. They have an average particle diameter of 6 $\mu$m, and to this toner, titanium oxide particles having an average particle diameter of 20 nm are added by a weight percent of 1%.

As for the magnetic carrier c, magnetic carrier having a saturation magnetization of 205 emu/cm$^3$ and an average particle diameter of 35 $\mu$m are used.

The thus prepared toner t is mixed with the carrier c at a weight ratio of 6:94 to be used as developer 46.

Since the toner particle produced by a polymerization method has a nearly spherical shape, additive can be uniformly coated thereon, which makes the toner particles easily separable from the photosensitive member 1. For example, when transfer efficiency (amount of toner transferred onto transfer sheet per unit area/amount of toner per unit area on photosensitive drum) was compared between the aforementioned pulverization toner and the polymerization toner, the former displayed an efficiency of 90%, whereas the latter displayed a much higher efficiency of 97%. In addition, the polymerization toner is preferable to the pulverization toner in terms of fog. When the polymerization toner was employed, fog could be prevented even when $V_{back}$ was 50 V.

When studies similar to those in the seventh and eighth embodiments were conducted using the polymerization toner, the amount of the post-transfer residual toner in this embodiment was extremely small. In addition, when the image forming apparatus employed in the studies had a cleaner-less structure in which the residual toner is concurrently cleaned as a latent image is developed, recovery efficiency was improved due to the highly separative properties of the polymerization toner, perfectly preventing the formation of the defective images.

When the main assembly of an image forming apparatus is stopped due to a jam caused by improper sheet conveyance or the like, during a developing operation or a transferring operation, the pulverization toner can be more efficiently recovered than the pulverization toner, because of its better separativity from the photosensitive drum. It could be confirmed that when the pulverization toner was employed, a photosensitive drum had to be rotated several times to recover the yet-to-be-transferred residual pulverization toner, whereas when the polymerization toner was employed, a photosensitive drum had to be rotated only once or twice to recover the yet-to-be-transferred residual polymerization toner. As a result, it is possible to shorten the length of the time necessary to clean the photosensitive drum before starting a normal image forming process, that is, the time necessary to recover the yet-to-be-transferred residual toner into the developing apparatus 4 by applying a DC voltage alone or an alternating voltage having a reduced amplitude.

<Miscellaneous Embodiments>

(1) The structure compatible with the present invention is not limited to those described in the preceding embodiments. On the contrary, the present invention is applicable to any contact type charging apparatus. For example, in the case of a cleaner-less image forming apparatus in which a developing apparatus doubles as a cleaning means and concurrently carries out the cleaning process and the developing process, its contact type charging means may be constituted of a charging apparatus comprising a charge roller formed of electrically conductive rubber or electrically conductive sponge, or may be constituted of a charging apparatus comprising a magnetic brush or a fur brush which does not rotates. Needless to say, the structure in accordance with the present invention is also applicable to an image forming apparatus comprising a cleaning apparatus, and such an application creates the same effects as those described above, and therefore, extends the service life of the charging member.

(2) The contact type charging member may be rotated in such a manner that it moves in the same direction as the image bearing member, in the contact nip formed by the object to be charged and the contact type charging member, or may be rendered stationary.

(3) In consideration of usage of a charge injection system and prevention of ozone generation, it is preferable that the photosensitive member is provided with a surface layer having a low resistance value in a range of $\mathbf{10^9}$—$\mathbf{10^{14}}$ Ω.cm. However, a satisfactory effect in terms of charging member contamination may be obtained with the use of organic photosensitive members other than those described above. In the case of an electrostatic recording system, the object to be charged may be a dielectric member.

(4) In the preceding embodiments, the developing method is described with reference to the two component developing method. However, the present invention is usable with other developing methods to obtain the same effects. Among them, the contact type single component developing method and the contact type two component developing method, in which an image is developed through the contact between developer and a photosensitive member, are preferable since they are effective to improve efficiency with which the toner recovering process and the image developing process are concurrently carried out. The developing method may be a normal developing method.

(5) When the polymerization toner particles are used as the toner particles t in developer as they were in the third embodiment, not only the aforementioned contact type single component developing method and contact type two component developing method, but also, the noncontact type single component developing method and the noncontact type two component developing method can be used to obtain satisfactory results in toner recovery.

(6) Further, the image exposing means as a means for writing imaging information on the charged surface of an image bearing member does not need to be limited to an exposing means employing a scanning laser system, such as the one described in the preceding embodiments, which forms a digital latent image. On the contrary, the present invention is compatible with any exposing means as long as it can form an electrostatic latent image corresponding to imaging data. For example, it may be an ordinary analog exposing means employing a light emitting element such as an LED, an exposing means constituted of a combination of a light emitting element such as a fluorescent light, a liquid crystal shutter, and the like, or the like exposing means.

Further, the image bearing member may be an electrostatically recording dielectric member. In such a case, the surface of a dielectric member is uniformly charged to a predetermined polarity and a predetermined potential level through a primary charging process, and then, the uniform charge is selectively removed from the charged surface using a discharging means such as a discharging needle head or an electron gun, to form an electrostatic latent image corresponding to a target image.

(7) As for transferring means, the present invention is obviously compatible with not only the roller transfer system, but also a blade transfer system, various contact type transfer charge systems, a transfer system employing a corona type discharging device, or the like, as well as a transfer drum, a transfer belt, an intermediate transfer member, and the like. Needless to say, the present invention is applicable to not only a monochromatic image forming apparatus, but also an image forming apparatus which forms a multicolor image and a full-color image through a multiple transfer steps.

(8) As for the waveform of alternating voltage applied to a contact type charging member or a developing means, a sine wave, a rectangular wave, a triangular wave, or the like may be optionally used. Also, it may be a rectangular wave formed by periodically turning on and off a DC power source. In other words, any bias may be used as long as its voltage value periodically changes.

(9) The contact type charging member may be disposed in a process cartridge removably mountable in the main assembly of an image forming apparatus. In this case, the process cartridge comprises at least an image bearing member in addition to the charging member.

(10) The present invention is quite valuable in converting a certain type of image display apparatus into a cleanerless apparatus in which a process of removing a toner image after it is displayed, and a process of developing a latent image, are concurrently carried out by a developing means. In such an image display apparatus, a toner image corresponding to pertinent image data is formed on an electrophotographic photosensitive member or an electrostatically recording dielectric member as an image bearing member in the form of a rotating belt, in the toner image forming station, which is located in a display section so that the image of the toner image is displayed on a displaying means. After the image of the toner image is displayed, the toner image is removed from the surface of the image bearing member without being transferred onto a transfer material, and the image bearing member is repeatedly used to form images to be displayed.

While the invention has been described with reference to the structures disclosed herein, it is not confined to the details set forth, and this application is intended to cover such modifications or changes as may come within the purposes of the improvements or the scope of the following claims.

What is claimed is:

1. An image forming apparatus, comprising:

an image bearing member for bearing a toner image;

a charging member contactable to said image bearing member to electrically charge said image bearing member;

wherein a potential difference, $\delta V=|Vdc-Vs|$ is different between a first area of said image bearing member which is going to be an image area and a second area of said image bearing member which is going to be a non-image area, wherein $|Vdc|\geqq|Vs|$ is satisfied in the first area and the second area, wherein $\delta V$ is larger for the second area than for the first area, wherein in said second area, a toner having the same polarity as a regularly charged toner can be transferred from said charging member to said image bearing member;

where Vdc is a DC component of a voltage applied to said charging member, and Vs is a potential of said image bearing member charged by said charging member when said charging member is supplied with Vdc.

2. An apparatus according to claim 1, wherein the voltage applied to said charging member is different between for the first area and for the second area.

3. An apparatus according to claim 1, wherein the voltage applied to said charging member is in the form of an AC biased DC voltage for the first area, and is in the form of a DC voltage without AC component for the second area.

4. An apparatus according to claim 1, wherein the voltage applied to said charging member is in the form of an AC biased DC voltage for the first and second areas, and a peak-to-peak voltage of AC component is smaller for the second area than for the first area.

5. An apparatus according to claim 1, wherein said image bearing member has a surface layer having a volume resistivity of $10^9$–$10^{14}$ ohm.cm.

6. An apparatus according to claim 5, wherein said image bearing member has a photosensitive layer inside a surface layer, and said surface layer comprises resin material and electroconductive particles dispersed therein.

7. An apparatus according to claim 1, wherein said image bearing member has an amorphous silicon photosensitive layer.

8. An apparatus according to claim 1, wherein said charging member has a magnetic particle layer contacted to said image bearing member.

9. An apparatus according to claim 1, wherein said charging member has a fiber brush contacted to said image bearing member.

10. An apparatus according to claim 1, wherein said second area is formed upon reactuation of main switch of said apparatus after interruption of said image forming operation.

11. An apparatus according to claim 1, wherein said second area is formed upon actuation of main switch of said apparatus.

12. An apparatus according to any one of claims 1–4 or 5–11, further comprising developing means for developing said image bearing member with toner of a polarity which is the same as the charging polarity of said charging member.

13. An apparatus according to any one of claims 1–4 or 5–11, further comprising developing means for developing said image bearing member with toner, and said developing means has a function of removing residual toner from said image bearing member.

14. An apparatus according to claim 13, wherein said developing means is capable of removing the residual toner from aid image bearing member during developing operation thereof.

15. An apparatus according to claim 13, wherein said developing means develops said image bearing member with the toner having the same polarity as the charging polarity of said charging member.

16. An apparatus according to claim 13, wherein said developing means has a toner carrying member for carrying the toner, and the toner carried on said carrying member is contactable to said image bearing member.

17. An apparatus according to claim 16, wherein said developing means contains a developer comprising toner and carrier.

18. An apparatus according to claim 13, wherein the toner has been produced through polymerization method.

19. An apparatus according to claim 1, wherein $\delta V$ for the first area is not more than 40V.

20. An apparatus according to claim 1 or 19, wherein $\delta V$ for the second area is larger than 50V.

* * * * *

UNITED STATES PATENT AND TRADEMARK OFFICE

CERTIFICATE OF CORRECTION

PATENT NO. : 5,835,821

DATED : November 10, 1998

INVENTOR(S) : HIROYUKI SUZUKI ET AL.

It is certified that error appears in the above-identified patent and that said Letters Patent is hereby corrected as shown below:

On the title page, item:

[57] ABSTRACT

Line 9, "is" (second occurrence) should be deleted.

COLUMN 1

Line 33, "preferably." should read --preferably--.

COLUMN 3

Line 31, "an" should read --and--.
Line 36, "is a" should be deleted.

COLUMN 5

Line 58, "Amilian" should read --Amilan--.

COLUMN 6

Line 56, "Surface" should read --surface--.

COLUMN 10

Line 19, "back side" should read --backside--.
Line 24, "no" should read --not--.

COLUMN 11

Line 30, "from" should read --from being--.

UNITED STATES PATENT AND TRADEMARK OFFICE

CERTIFICATE OF CORRECTION

PATENT NO. : 5,835,821

DATED : November 10, 1998

INVENTOR(S) : HIROYUKI SUZUKI ET AL.

It is certified that error appears in the above-identified patent and that said Letters Patent is hereby corrected as shown below:

COLUMN 17

Line 37, "(SnO2) should read --($SnO_2$)--.

COLUMN 19

Line 37, "nC" should read --DC--.

COLUMN 20

Line 8, "mares" should read --makes--.

COLUMN 25

Line 17, "3 As" should read --3. As--.

COLUMN 27

Line 3, "toner" (second occurrence) should be deleted.

COLUMN 28

Line 3, "rotates." should read --rotate.--.

UNITED STATES PATENT AND TRADEMARK OFFICE

CERTIFICATE OF CORRECTION

PATENT NO. : 5,835,821

DATED : November 10, 1998

INVENTOR(S) : HIROYUKI SUZUKI ET AL.

It is certified that error appears in the above-identified patent and that said Letters Patent is hereby corrected as shown below:

COLUMN 29

Line 7, "a" (third occurrence) should be deleted.
Lines 17-20, Close up left margin.
Lines 22-38, Close up left margin.

Signed and Sealed this

Second Day of November, 1999

*Attest:*

Q. TODD DICKINSON

*Attesting Officer*

*Acting Commissioner of Patents and Trademarks*